US006510306B2

(12) United States Patent
Ashikari

(10) Patent No.: US 6,510,306 B2
(45) Date of Patent: Jan. 21, 2003

(54) TONER REPLENISHING DEVICE AND TONER CARTRIDGE THEREOF

(75) Inventor: Tsutomu Ashikari, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/968,805

(22) Filed: Oct. 3, 2001

(65) Prior Publication Data

US 2002/0064401 A1 May 30, 2002

(30) Foreign Application Priority Data

Nov. 30, 2000 (JP) ..... 2000-366185

(51) Int. Cl.[7] ..... G03G 15/08
(52) U.S. Cl. ..... 399/258; 399/260
(58) Field of Search ..... 399/258, 260, 399/262, 263, 106

(56) References Cited

U.S. PATENT DOCUMENTS 5,207,353 A * 5/1993 Corby et al. ..... 399/260 X
5,812,914 A * 9/1998 Johroku ..... 399/262
6,418,292 B1 * 7/2002 Isobe et al. ..... 399/258

* cited by examiner

*Primary Examiner*—William J. Royer
(74) *Attorney, Agent, or Firm*—Smith, Gambrell & Russell, LLP

(57) ABSTRACT

A toner replenishing device including a mounting portion having an accepting upper surface where a toner replenishment port is open, a toner cartridge including a container body having a support wall portion in which a toner discharge port is open, and a shutter member; and the toner cartridge thereof. A toner discharge port sealing member is disposed on a lower surface of the support wall portion. A toner replenishment port sealing member is disposed on the accepting upper surface. A pair of guide wall portions and stop walls are provided on the mounting portion. The shutter member is mounted such that its opposite ends protrude from both ends of the support wall portion, and the opposite ends of the shutter member are inserted into the pair of guide wall portions, whereby the container body is removably located at an inserting position.

15 Claims, 16 Drawing Sheets

TONER REPLENISHING DEVICE AND TONER CARTRIDGE THEREOF

FIELD OF THE INVENTION

This invention relates to a toner replenishing device for replenishing a developing device with a toner in an image forming machine, such as an electrostatic copier, a laser printer, or a facsimile, and a toner cartridge for use in the toner replenishing device.

DESCRIPTION OF THE PRIOR ART

In an image forming machine, such as an electrostatic copier, a developing device for developing an electrostatic latent image formed on a photoconductor drum is disposed. The developing device applies a toner to the electrostatic latent image to develop it into a toner image. Normally, the toner consumed with the progress of development is supplied from a toner cartridge removably mounted on a mounting portion disposed at a required position of the developing device. When the toner in the toner cartridge has been consumed completely, the toner cartridge is replaced by a new toner cartridge.

Japanese Unexamined Patent Publication No. 2000-56550 discloses a toner replenishing device in which a toner cartridge accommodating a toner is mounted removably. The toner replenishing device disclosed in this publication has a toner cartridge receiving mechanism disposed in a toner cartridge mounting portion of a machine housing of a copier, and a toner cartridge detachably mounted on the toner cartridge receiving mechanism. The toner cartridge comprises a container body having a toner discharge port, and a shutter member disposed movably between a closing position at which it closes the toner discharge port and an opening position at which it opens the toner discharge port. A mouth-and-neck portion having the toner discharge port is provided at the bottom wall of the container body of the toner cartridge, and a rectangular flange is formed at the lower end of the mouth-and-neck portion. The shutter member is disposed in this flange. In the shutter member, guide grooves are formed in guide portions disposed at both ends of a flat plate portion, and the shutter member is slidably mounted on the flange via each of the guide grooves. A stopper claw portion is disposed in one of the guide portions. The stopper claw portion is composed of a support portion elastically deformable in a direction separated from one side portion of the flange, a guided portion formed from the front end of the support portion toward the one side portion of the flange, and a stopper portion formed from the front end of the support portion toward the outside. A notch portion is formed at the front end of the one side portion of the flange, and when the shutter member is located at the closing position, the guided portion enters the notch portion, and the support portion is not deformed. A sealing member for sealing the toner discharge port is strippably mounted on the lower surface of the flange. A connecting mechanism having a toner accepting opening is disposed in the toner cartridge mounting portion. The connecting mechanism includes a bottom surface portion shared with an upper wall of a development housing, and a pair of side walls protruding upward from bilateral end sides of the bottom surface portion and extending parallel along a direction of movement of the toner cartridge from a detaching position to a mounting position. An engaging convex is formed on one of the side walls. The toner accepting opening is formed at a predetermined position of the bottom surface portion. An engagement portion, which the flange of the container body engages, is formed around the toner accepting opening. The engagement portion has engagement side wall portions formed at both side edges of the toner accepting opening along the direction of movement of the toner cartridge from the detaching position to the mounting position, a restraint portion formed at the depth-side edge of the toner accepting opening, and a placing portion formed at the upper end of the engagement side wall portions and the restraint portion.

When the toner cartridge is placed at the detaching position of the toner cartridge receiving mechanism and moved toward the mounting position, one of the guide portions of the shutter member contacts one of the engagement side wall portions to have its movement restrained. Upon further movement of the toner cartridge, the flange is inserted into a region defined by the engagement portion, and its front end contacts the restraint portion to restrain its movement. The shutter member is moved in the closing direction relative to the flange. As a result, the sealing member is stripped, and the toner discharge port is opened. At this time, the toner discharge port is positioned to face the upper side of the toner accepting opening of the development housing. The guided portion of the shutter member leaves the notch portion, and contacts one side surface of the flange. Thus, the support portion is elastically deformed so as to jut out away from one side portion of the flange. The toner cartridge is located at a predetermined mounting position, and the container body is placed on the placing portion. When the toner cartridge is moved from the mounting position toward the detaching position for its replacement, the stopper portion of the support portion in the jutting state engages the engaging convex to have its movement restrained. The shutter member moves relative to the flange to close the toner discharge port. When the toner cartridge further moves, the guided portion enters the notch portion of one side surface of the flange, releasing the elastic deformation of the support portion. Thus, the stopper portion disengages from the engaging convex to dissolve its interference in the moving direction. The toner cartridge is located at the toner cartridge removal position, with the shutter member closing the toner discharge port.

In the toner replenishing device described above, when the toner cartridge is located at the predetermined mounting position, the flange is positioned in the engagement portion, and the toner discharge port is brought above, and opposed to, the toner accepting opening of the development housing. With this configuration, however, a gap is formed between the flange of the container body and the engagement portion at the time of mounting. During operation of the copier, toner may leak through this gap to the outside and scatter. When the toner cartridge is removed, much toner may be carried outside while adhering to the shutter member, and scatter.

There has also been developed a toner replenishing device of a type comprising a toner cartridge mounting portion having a toner replenishment port, and a toner cartridge mounted on the mounting portion, in which the cartridge includes a container body having a toner discharge port, a shutter member is mounted on the container body so as to be movable forward and backward between a closing position at which the shutter member covers the toner discharge port and an opening position at which the shutter member opens the toner discharge port, the container body is inserted into the mounting portion up to an inserting position in an inserting direction perpendicular to the directions of forward and backward movements, and is then moved up to a mounting position in a mounting direction in the directions of forward and backward movements, whereby the cartridge is removably mounted on the mounting portion. A toner passage port is formed in the shutter member, and when the container body is located at the inserting position, the toner passage port is positioned to align with the toner replenishment port of the developing device. When the container body is moved from the inserting position to the mounting position, the shutter member is moved in an opening direction relative to the container body, whereupon the toner discharge port, the toner passage port of the shutter member, and the toner replenishment port are positioned in alignment. In this type of toner replenishing device, the container body needs to be accurately positioned in the mounting portion so that the toner discharge port, the toner passage port of the shutter member, and the toner replenishment port align. The above-described conventional type of toner replenishing device, however, is configured such that the above positioning is performed by installing a guide mechanism or the like of the container body at a site of the machine spaced from the position where the toner replenishment port is present. Hence, misalignment occurs among the toner discharge port, the toner passage port of the shutter member, and the toner replenishment port by the influence of cumulative errors of the respective members. As a result, a relatively large amount of toner is likely to adhere to their peripheral edges. In this case, replenishment of toner during operation of the copier is possible, but a relatively large amount of toner may scatter and contaminate the surroundings when the container body is removed.

SUMMARY OF THE INVENTION

An object of the present invention is to provide a novel toner replenishing device, and a toner cartridge thereof, which can prevent leakage and scatter of toner markedly effectively at the time of toner replenishment and mounting of a container body on a mounting portion or removal of the container body from the mounting portion.

Another object of the present invention is to provide a novel toner replenishing device, and a toner cartridge thereof, which can remarkably diminish misalignment among a toner discharge port of the container body, a toner passage port of a shutter member, and a toner replenishment port of a developing device.

Still another object of the present invention is to provide a novel toner replenishing device, and a toner cartridge thereof, which can conspicuously improve the sealability of the toner discharge port of the container body, the toner passage port of the shutter member, and the toner replenishment port of the developing device.

According to an aspect of the present invention, there is provided a toner replenishing device comprising a toner cartridge mounting portion having a toner replenishment port, and a toner cartridge mounted on the mounting portion, and being configured such that the cartridge including a container body having a toner discharge port, a shutter member is mounted on the container body so as to be movable forward and backward between a closing position at which the shutter member covers the toner discharge port and an opening position at which the shutter member opens the toner discharge port, and the container body is inserted into the mounting portion up to an inserting position in an inserting direction perpendicular to the directions of the forward and backward movements, and is then moved up to a mounting position in a mounting direction in the directions of the forward and backward movements, whereby the cartridge is removably mounted on the mounting portion, and wherein the container body is provided with a support wall portion having a lower surface at which the toner discharge port is open, a flexible toner discharge port sealing member having a toner passage port formed therein is disposed on the lower surface of the support wall portion, with the toner passage port being positioned in alignment with the toner discharge port, and the shutter member has a toner passage port, and is supported by the support wall portion and located at the closing position, with an upper surface of the shutter member being pressed against a lower surface of the toner discharge port sealing member, and is also positioned such that opposite end portions of the shutter member in the directions of the forward and backward movements protrude outwardly of opposite ends of the support wall portion, the mounting portion includes an accepting upper surface where the toner replenishment port is open, a flexible toner replenishment port sealing member disposed on the accepting upper surface and having a toner passage port formed therein, a pair of guide wall portions disposed so as to extend in the inserting direction while interposing the toner replenishment port sealing member therebetween, and stop walls extending toward each other at downstream ends in the inserting direction of the guide wall portions, the toner passage port of the toner replenishment port sealing member being positioned in alignment with the toner replenishment port, when the container body is moved in the inserting direction relative to the mounting portion to insert the opposite end portions of the shutter member into the corresponding guide wall portions and move the opposite end portions along them, the opposite end portions contact the corresponding stop walls to have their movement inhibited, whereby the container body is inserted and positioned at the inserting position, a lower surface of the shutter member is pressed against an upper surface of the toner replenishment port sealing member and sealed thereby, and the toner passage port of the shutter member is positioned in alignment with the toner passage port of the toner replenishment port sealing member and the toner replenishment port, then when the container body is moved in the mounting direction relative to the mounting portion, the shutter member contacts the guide wall portion on a mounting direction side to have its movement inhibited, and when the support wall portion is moved, relative to the shutter member, in the mounting direction by a predetermined stroke, the support wall portion partly contacts a front end of the stop wall on the mounting direction side to have its movement inhibited, so that the container body is located at the mounting position, and upon movement of the container body up to the mounting position, the shutter member is relatively moved from the closing position to the opening position, the toner discharge port, the toner passage port of the toner discharge port sealing member, the toner passage port of the shutter member, the toner passage port of the toner replenishment port sealing member, and the toner replenishment port are positioned in alignment, and the upper surface and lower surface of the shutter member are pressed against the toner discharge port sealing member and the toner replenishment port sealing member, respectively, and sealed thereby.

Preferably, the pair of guide wall portions include guide side walls erected from the accepting upper surface so as to extend parallel in the inserting direction with spacing therebetween, and upper walls extending toward each other perpendicularly from the upper ends of the guide side walls, the stop walls are formed so as to extend toward each other perpendicularly from the downstream ends in the inserting direction of the guide side walls, the overall height of the guide wall portion disposed on the mounting direction side is lower than the overall height of the other guide wall portion, and channel-shaped guide grooves having open ends facing each other are formed by the guide wall portions on the accepting upper surface.

In the guide wall portion disposed on the mounting direction side, it is preferred that a corner at which the upper surface and the front end surface of the upper wall cross is formed in a curved surface and a corner at which the upper wall and the guide side wall cross is formed in a curved surface.

Preferably, the container body of the toner cartridge includes a front side wall, and a bottom wall formed in an upper end portion of the front side wall and having a toner transport path formed inside and having the toner discharge port formed in one end portion thereof in a longitudinal direction, a toner discharge portion having a support wall portion integrally formed so as to extend forwardly horizontally from the upper end portion of the front side wall and extend along the lower surface of the bottom wall is disposed in one end portion in the longitudinal direction of the container body and in one end portion of the toner transport path, the toner discharge port is disposed so as to be open at the lower surface of the support wall portion, channel-shaped guide grooves having open ends facing each other are formed by guide side walls and support flanges at opposite ends in a width direction of the support wall portion, the guide side walls being formed so as to extend from one end toward the other end in the longitudinal direction of the support wall portion over a length at a predetermined position shorter than the overall length in the longitudinal direction of the support wall portion and extending perpendicularly downwardly from the opposite ends in the width direction of the support wall portion, the support flanges extending perpendicularly toward each other from the lower ends of the guide side walls, the toner discharge port sealing member is disposed on the lower surface of the support wall portion so as to surround the peripheral edge of the toner discharge port, the longitudinal length of the support wall portion is set to be shorter than the distances between the front ends of the stop walls and the upper walls in the accepting portion, and the shutter member is supported in the support wall portion so as to be movable forward and backward in the longitudinal direction consistent with the mounting direction and a dismounting direction.

Preferably, the shutter member includes a body portion of a substantially rectangular flat plate shape and having a toner passage port formed therein, supported flanges extending horizontally in a laterally outward manner from the upper surface at opposite ends in the width direction of the body portion, and a protrusive wall extending upwardly perpendicularly from one end in the longitudinal direction of the body portion, the lower surface of each of the supported flanges is positioned substantially on the same plane as the upper surface of the body portion, the supported flanges are formed so as to extend linearly from one end toward the other end in the longitudinal direction of the body portion along the opposite ends of the body portion with the same constant width, the other end portion of the body portion protrudes by a predetermined length from the other end of each of the supported flanges, when the supported flanges are inserted into the corresponding guide grooves of the support wall portion of the container body from one end of the support wall portion and moved toward the other end of the support wall portion, and the protrusive wall contacts one end of the support wall portion to have its movement inhibited, the shutter member is supported by the guide grooves so as to be relatively movable in the longitudinal direction, with the upper surface of the shutter member elastically deforming the lower surface of the toner discharge port sealing member toward the lower surface of the support wall portion, the toner passage port in the upper surface of the body portion of the shutter member has a peripheral edge pressed against the toner discharge port sealing member and closed thereby, the toner passage port of the toner discharge port sealing member, and the toner discharge port are closed with the body portion of the shutter member, and the shutter member is located at the closing portion at which the shutter member covers the toner discharge port.

When the shutter member is mounted on the support wall portion and located at the closing position, it is preferred that the protrusive wall being one end portion of the shutter member is positioned so as to protrude longitudinally outwardly from one end of the support wall portion, and the other end portion of the body portion being the other end portion of the shutter member is positioned so as to protrude longitudinally outwardly from the other end of the support wall portion.

When the container body of the toner cartridge is placed on the placing surface of the mounting portion, the toner discharge portion of the container body is aligned with the accepting portion of the mounting portion, and then the container body is moved in the inserting direction, the protrusive wall of the shutter member protruding from one end portion of the support wall portion is inserted into the guide groove of the guide wall portion on the dismounting direction side, the other end portion of the shutter member protruding from the other end portion of the support wall portion is inserted into the guide groove of the guide wall portion on the mounting direction side, and the protrusive wall and the other end portion are moved under guidance thereby, the support flange of the support wall portion and the lower surface of the shutter member are moved while compressing and elastically deforming the toner replenishment port sealing member, when the protrusive wall and the other end portion of the shutter member are contacted with the corresponding stop walls to have their movements restrained, the support wall portion is positioned between the guide wall portions to locate the container body at the inserting position, the lower surface of the shutter member including the peripheral edge of the toner passage port is pressed against the upper surface of the toner replenishment port sealing member and sealed thereby, the upper surface of the shutter member including the peripheral edge of the toner passage port is pressed against the lower surface of the toner discharge port sealing member and sealed thereby, the toner discharge port of the support wall portion and the toner passage port of the toner discharge port sealing member are positioned with predetermined spacing from the toner replenishment port and the toner passage port of the toner replenishment port sealing member in the dismounting direction opposite to the mounting direction, and the toner passage port of the shutter member is positioned in alignment with the toner passage port of the toner replenishment port sealing member and the toner replenishment port.

Preferably, the end surface on the mounting direction side of the support flange of the support wall portion downstream in the inserting direction is positioned with predetermined spacing from the front end of the stop wall of the guide wall portion on the mounting direction side, the predetermined spacing is set to be substantially the same as the predetermined spacing between the toner discharge port of the support wall portion/the toner passage port of the toner discharge port sealing member and the toner replenishment port/the toner passage port of the toner replenishment port sealing member, and when the container body is located at the inserting position, the lower surface between the guide side walls of the support wall portion is located at a position higher by a predetermined distance than the upper surface of the upper wall of the guide wall portion on the mounting direction side.

Preferably, when the container body is moved in the mounting direction from the inserting position, the shutter member contacts the guide side wall of the guide wall portion on the mounting direction side to have its movement inhibited, whereby the support wall portion is moved in the mounting direction relative to the shutter member, with the shutter member remaining at the inserting position, and when the support wall portion is moved in the mounting direction by a predetermined stroke, the end surface on the mounting direction side of the support flange on the inserting direction side of the support wall portion contacts the front end of the stop wall of the guide wall portion on the mounting direction side, whereby the movement of the support wall portion is inhibited and the container body is located at the mounting position.

Preferably, when the container body is moved in the dismounting direction from the mounting position, the shutter member has the protrusive wall thereof contacting the guide side wall of the guide wall portion on the dismounting direction side to have its movement inhibited, and the support wall portion is moved in the dismounting direction relative to the shutter member present at the inserting position, and when the support wall portion is moved in the dismounting direction by the predetermined stroke, one end on the dismounting direction side of the support wall portion contacts the protrusive wall of the shutter member, whereby the movement of the support wall portion is inhibited and the container body and the support wall portion are returned to the inserting position, while the shutter member is moved relatively from the opening direction and located at the closing position.

According to. another aspect of the present invention, there is provided a toner cartridge to be mounted on a toner cartridge mounting portion of a toner replenishing device having a toner replenishment port, the mounting portion including an accepting upper surface where the toner replenishment port is open, a flexible toner replenishment port sealing member disposed on the accepting upper surface and having a toner passage port formed therein, a pair of guide wall portions disposed so as to extend in an inserting direction while interposing the toner replenishment port sealing member therebetween, and stop walls disposed at downstream ends in the inserting direction of the guide wall portions, the toner passage port of the toner replenishment port sealing member being positioned in alignment with the toner replenishment port, the toner cartridge including a container body having a toner discharge port, and configured such that a shutter member is mounted on the container body so as to be movable forward and backward between a closing position at which the shutter member covers the toner discharge port and an opening position at which the shutter member opens the toner discharge port, the container body is inserted into the mounting portion up to an inserting position in an inserting direction perpendicular to the directions of the forward and backward movements, and is then moved up to a mounting position in a mounting direction in the directions of the forward and backward movements, whereby the toner cartridge is removably mounted on the mounting portion, and wherein the container body is provided with a support wall portion having a lower surface in which the toner discharge port is open, a flexible toner discharge port sealing member having a toner passage port formed therein is disposed on the lower surface of the support wall portion, with the toner passage port being positioned in alignment with the toner discharge port, the shutter member has a toner passage port, and is supported by the support wall portion and located at the closing position, with an upper surface of the shutter member being pressed against a lower surface of the toner discharge port sealing member, and is also positioned such that opposite end portions of the shutter member in the directions of the forward and backward movements protrude outwardly of opposite ends of the support wall portion.

when the container body is moved in the inserting direction relative to the mounting portion to insert the opposite end portions of the shutter member into the corresponding guide wall portions and move the opposite end portions along them, the opposite end portions contact the corresponding stop walls to have their movement inhibited, whereby the container body is inserted and positioned at the inserting position, the lower surface of the shutter member is pressed against the upper surface of the toner replenishment port sealing member and sealed thereby, and the toner passage port of the shutter member is positioned in alignment with the toner passage port of the toner replenishment port sealing member and the toner replenishment port, then when the container body is moved in the mounting direction relative to the mounting portion, the shutter member contacts the guide wall portion on the mounting direction side to have its movement inhibited, and when the support wall portion is moved, relative to the shutter member, in the mounting direction by a predetermined stroke, the support wall portion partly contacts the front end of the stop wall on the mounting direction side to have its movement inhibited, so that the container body is located at the mounting position, and upon movement of the container body up to the mounting position, the shutter member is relatively moved from the closing position to the opening position, the toner discharge port, the toner passage port of the toner discharge port sealing member, the toner passage port of the shutter member, the toner passage port of the toner replenishment port sealing member, and the toner replenishment port are positioned in alignment, and the upper surface and lower surface of the shutter member are pressed against the toner discharge port sealing member and the toner replenishment port sealing member, respectively, and sealed thereby.

Preferably, the container body includes a front side wall, and a bottom wall formed in an upper end portion of the front side wall and having a toner transport path formed inside and having the toner discharge port formed in one end portion thereof in a longitudinal direction, a toner discharge portion having a support wall portion integrally formed so as to extend forwardly horizontally from the upper end portion of the front side wall and extend along the lower surface of the bottom wall is disposed in one end portion in the longitudinal direction of the container body and in one end portion of the toner transport path, the toner discharge port is disposed so as to be open at the lower surface of the support wall portion, channel-shaped guide grooves having open ends facing each other are formed by guide side walls and support flanges at opposite ends in a width direction of the support wall portion, the guide side walls being formed so as to extend from one end toward the other end in the longitudinal direction of the support wall portion over a length at a predetermined position shorter than the overall length in the longitudinal direction of the support wall portion and extending perpendicularly downwardly from the opposite ends in the width direction of the support wall portion, the support flanges extending perpendicularly toward each other from the lower ends of the guide side walls, the toner discharge port sealing member is disposed on the lower surface of the support wall portion so as to surround the peripheral edge of the toner discharge port, the longitudinal length of the support wall portion is set to be shorter than the distances between the front ends of the stop walls and the upper walls in the mounting portion, and the shutter member is supported in the support wall portion so as to be movable forward and backward in the longitudinal direction consistent with the mounting direction and a dismounting direction.

Preferably, the shutter member includes a body portion of a substantially rectangular flat plate shape and having a toner passage port formed therein, supported flanges extending horizontally in a laterally outward manner from the upper surface at opposite ends in the width direction of the body portion, and a protrusive wall extending upwardly perpendicularly from one end in the longitudinal direction of the body portion, the lower surface of each of the supported flanges is positioned substantially on the same plane as the upper surface of the body portion, the supported flanges are formed so as to extend linearly from one end toward the other end in the longitudinal direction of the body portion along the opposite ends of the body portion with the same constant width, the other end portion of the body portion protrudes by a predetermined length from the other end of each of the supported flanges, when the supported flanges are inserted into the corresponding guide groove of the support wall portion of the container body from one end of the support wall portion and moved toward the other end of the support wall portion, and the protrusive wall contacts one end of the support wall portion to have its movement inhibited, the shutter member is supported by the guide grooves so as to be relatively movable in the longitudinal direction, with the upper surface of the shutter member elastically deforming the lower surface of the toner discharge port sealing member toward the lower surface of the support wall portion, the toner passage port in the upper surface of the body portion of the shutter member has a peripheral edge pressed against the toner discharge port sealing member and closed thereby, the toner passage port of the toner discharge port sealing member, and the toner discharge port are closed with the body portion of the shutter member, and the shutter member is located at the closing portion at which the shutter member covers the toner discharge port.

When the shutter member is mounted on the support wall portion and located at the closing position, it is preferred that the protrusive wall being one end portion of the shutter member is positioned so as to protrude longitudinally outwardly from one end of the support wall portion, and the other end portion of the body portion being the other end portion of the shutter member is positioned so as to protrude longitudinally outwardly from the other end of the support wall portion.

Preferably, when the shutter member is moved from the closing position in the opposite direction relative to the support wall portion by a predetermined stroke, the shutter member is located at the opening position at which the toner passage port of the body portion aligns with the toner passage port of the toner discharge port sealing member and the toner discharge port.

DETAILED DESCRIPTION OF THE PREFERRED EMBODIMENTS

Preferred embodiments of a toner replenishing device in an image forming machine constituted in accordance with the present invention, and its toner cartridge will now be described in more detail with reference to the accompanying drawings.

Figure 1:
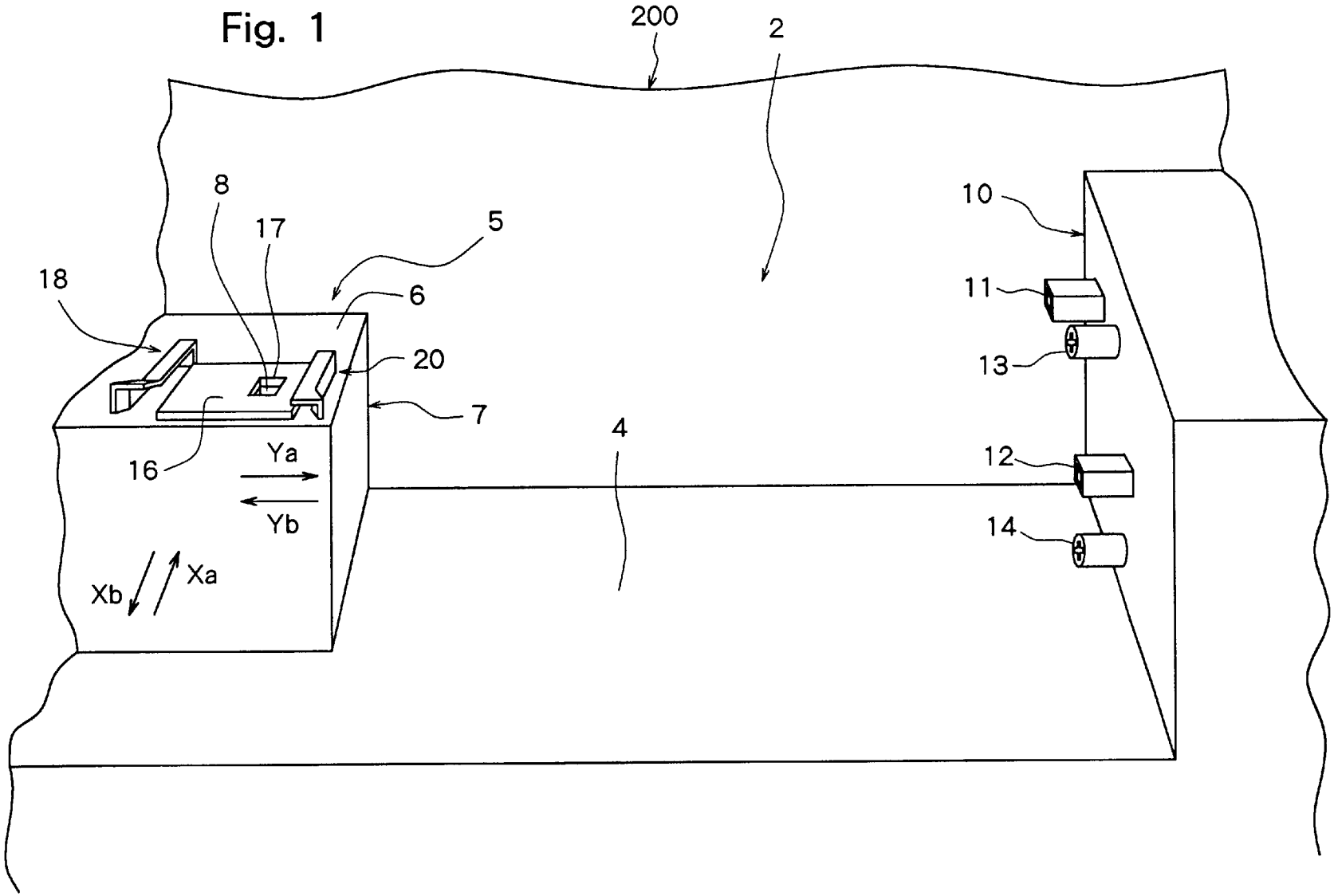
FIG. 1 is a perspective schematic view showing a toner cartridge mounting portion of a copier body equipped with part of a toner replenishing device according to the present invention.

With reference to FIG. 1, a toner cartridge mounting portion 2 is formed on a front surface of a copier body 200 of a copier not entirely shown. The mounting portion 2 includes a flat placing surface 4 on which a container body 26 of a toner cartridge 25 to be described later (see FIGS. 2 and 3) is inserted and placed, and an accepting portion 5 for accepting and positioning a toner discharge portion 30 (to be described later) of the toner cartridge 25. The accepting portion 5 has an accepting upper surface 6. The accepting upper surface 6 comprises a flat upper surface formed on a depth side of the placing surface 4 and at a higher position than the placing surface 4. In the embodiment, the accepting upper surface 6 is formed from an upper surface of an upper wall 7*a* of a development housing 7 (see FIG. 19) in a developing device mounted on the copier body 200. A toner replenishment port 8 is formed in the upper wall 7*a* of the development housing 7, and the toner replenishment port 8 is formed in a nearly square shape and also formed to be open at the accepting upper surface 6. A drive device accommodation housing 10 is disposed to the right in FIG. 1 of the toner cartridge mounting portion 2. In the housing 10, a drive device including an electric motor, a power transmission mechanism, etc. (not shown) is disposed. This drive device is intended to drive an agitating/scooping mechanism and a toner transport mechanism provided in the toner cartridge 25. Driving connecting members 11 and 12 for the power transmission mechanism, and positioning guide tubes 13 and 14 are disposed protrusively on a side of the housing 10 facing the placing surface 4.

In FIG. 1, the symbol Xa denotes a substantially horizontal inserting direction of the container body 26 of the toner cartridge 25 for insertion into the mounting portion 2 (i.e., a direction from ahead of the copier body 200 toward behind the copier body 200 in FIG. 1), the symbol Xb denotes a removing direction opposite to Xa (i.e., a direction from behind the copier body 200 toward ahead of the copier body 200 in FIG. 1), the symbol Ya denotes a substantially horizontal mounting direction, in the mounting portion 2, of the container body 26 inserted into the mounting portion 2 (i.e., a direction from the left toward the right of the copier body 200 in FIG. 1), and the symbol Yb denotes a dismounting direction opposite to Ya (i.e., a direction from the right toward the left of the copier body 200 in FIG. 1). The above directions are true of the descriptions to follow.

Figure 18:
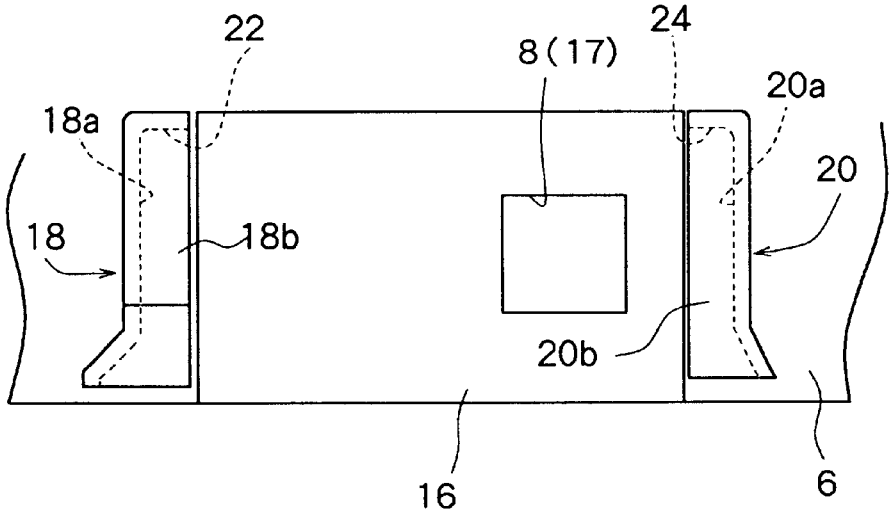
FIG. 18 is a plan view of an accepting portion provided in the toner cartridge mounting portion.
Figure 19:
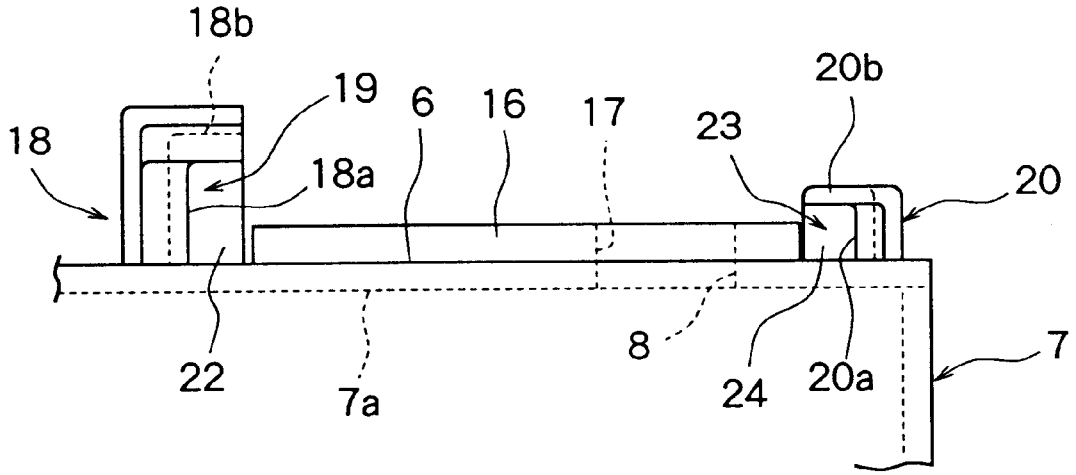
FIG. 19 is a front view of the accepting portion shown in FIG. 18.
Figure 20:
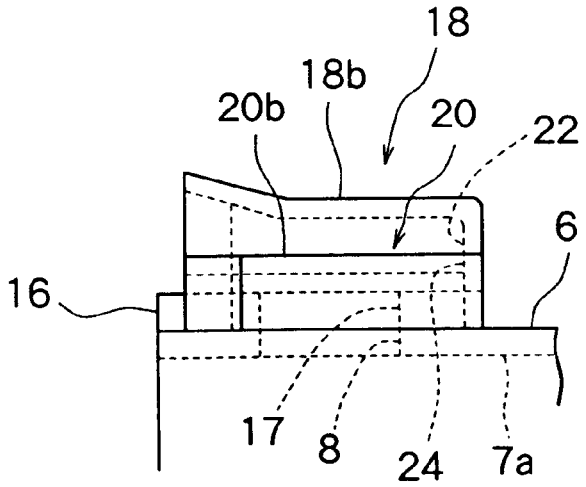
FIG. 20 is right side view of the accepting portion shown in FIG. 18.
Figure 21:
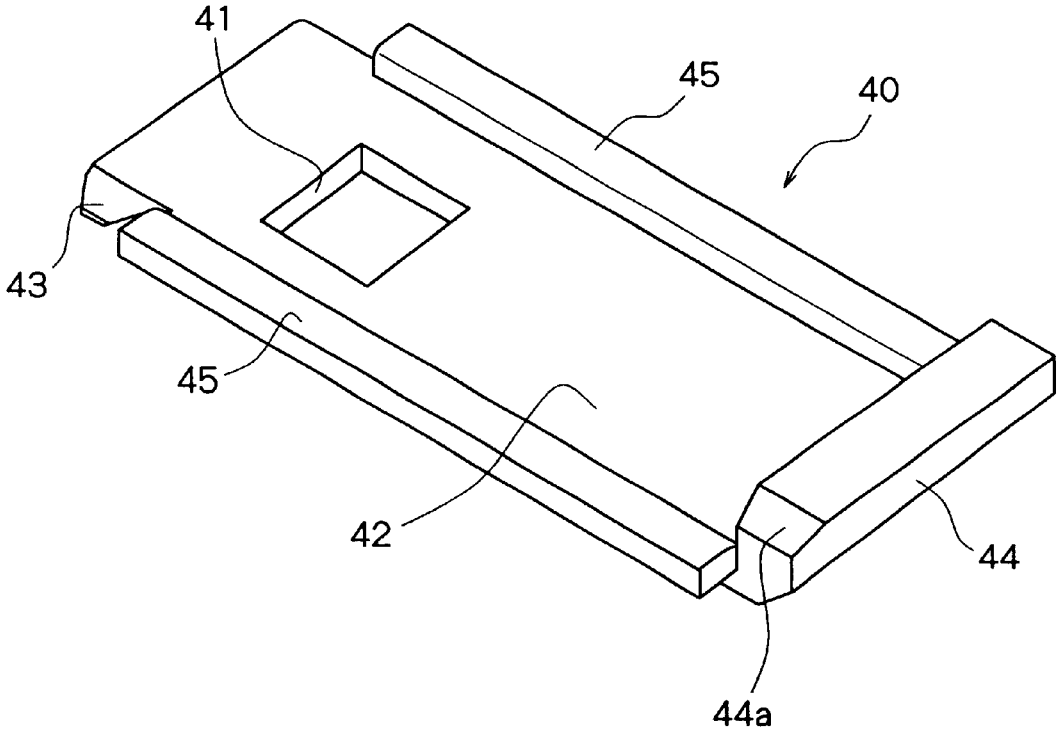
FIG. 21 is a perspective view of a shutter member.
Figure 22:
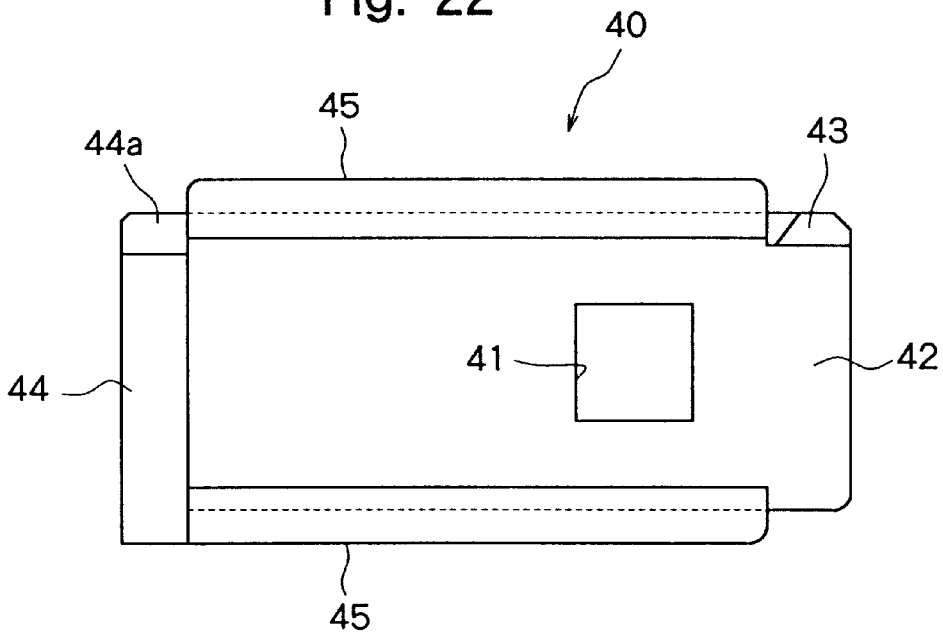
FIG. 22 is a plan view of the shutter member shown in FIG. 21.
Figure 23:
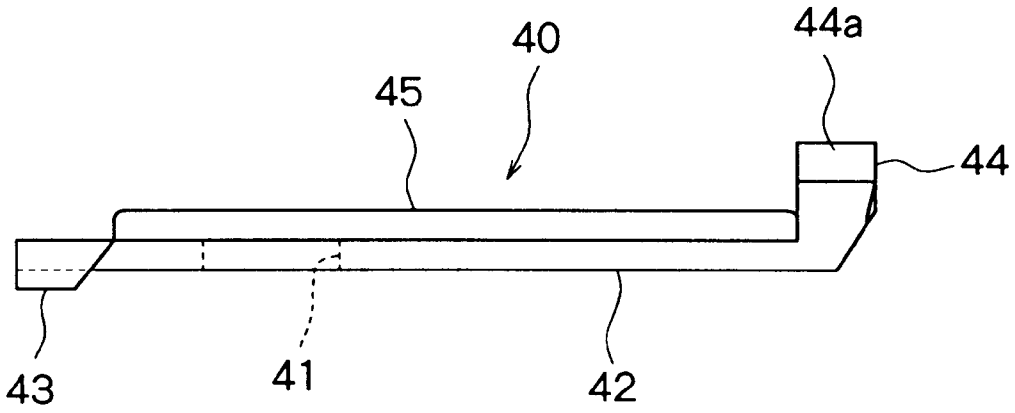
FIG. 23 is a right side view of the shutter member shown in FIG. 22.
Figure 24:
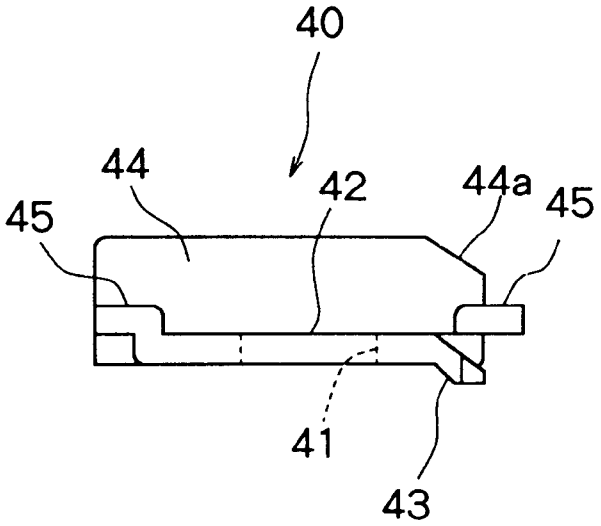
FIG. 24 is another side view of the shutter member shown in FIG. 22.

With reference to FIGS. 18 to 20, a flexible toner replenishment port sealing member 16 is disposed on the accepting upper surface 6 of the accepting portion 5 so as to surround the peripheral edge of the toner replenishment port 8. The sealing member 16 formable from a flexible material such as urethane foam has a nearly constant thickness, takes a rectangular planar shape, and is bonded to the accepting upper surface 6. A toner passage port 17 for passage of a toner is formed in the sealing member 16. The toner passage port 17 has substantially the same shape and size as those of the toner replenishment port 8, and is disposed in alignment with the toner replenishment port 8.

Guide wall means for accepting the toner discharge portion 30 of the container body 26 of the toner cartridge 25 and guiding it in the inserting direction, and insertion movement restraining means for restraining the movement of the toner discharge portion 30 in the inserting direction and positioning the toner discharge portion 30 at a predetermined inserting position are provided on the accepting upper surface 6. The guide wall means includes a pair of guide wall portions, 18 and 20, disposed so as to extend in the inserting direction of the toner cartridge 25 (the direction from below toward above in FIG. 18; the direction from face to back in FIG. 19) while interposing the sealing member 16 therebetween. The guide wall portions 18 and 20 include guide side walls 18*a* and 20*a* erected from the accepting upper surface 6 so as to be spaced from each other and extend parallel in the inserting direction, and upper walls 18*b* and 20*b* extending toward each other perpendicularly from the upper ends of the guide side walls 18*a* and 20*a*. The guide side walls 18*a* and 20*a* are formed so as to have upstream ends in the inserting direction fanning out toward the upstream side and away from each other, but other regions of the guide side walls 18*a* and 20*a* extend linearly in the inserting direction. The upper wall 18*b* of the guide side wall 18*a* is formed so as to have an upstream end in the inserting direction fanning out upwardly toward the upstream side, but other regions of the upper wall 18*b* are formed to have a constant height (the height from the accepting upper surface 6 to the lower surface of the upper wall 18*b*). The upper wall 20*b* of the guide wall portion 20 is formed to have a constant height over the entire region, and the corner of the upper wall 20*b* at which its upper surface and its front end surface cross is formed to have a curved surface. Of the guide wall portions 18 and 20, the guide wall portion 20 disposed on the mounting direction side of the toner cartridge 25 (the right side in FIGS. 18 and 19) has an overall height lower than the overall height of the guide wall portion 18. As clear from the above descriptions, channel-shaped guide grooves 19 and 23 whose open ends face each other are formed on the accepting upper surface 6 by the guide wall portions 18 and 20.

The insertion movement restraining means is composed of stop walls 22 and 24 extending toward each other at the deepest ends in the inserting direction of the guide wall portions 18 and 20. The stop walls 22 and 24 are formed so as to extend toward each other perpendicularly from the downstream ends in the inserting direction of the guide side walls 18*a* and 20*a*, and the upper ends of the stop walls 22 and 24 are connected to the lower surfaces of the rear ends in the inserting direction of the upper walls 18*b* and 20*b*. The front ends of the upper wall 18*b* of the guide wall portion 18 and the stop wall 22 are located on a common vertical surface, and the front ends of the upper wall 20*b* of the guide wall portion 20 and the stop wall 24 are located on a common vertical surface. Both of the vertical surfaces are parallel to each other. Both ends, in the mounting and dismounting directions, of the sealing member 16 are located inwardly of both vertical surfaces. The rear surfaces in the inserting direction of the stop walls 22, 24 and the sealing member 16 are positioned on a common vertical surface, while the front end surfaces in the inserting direction of the guide side wall 18*a* and upper wall 18*b* of the guide wall portion 18 and the guide side wall 20*a* and upper wall 20*b* of the guide wall portion 20 are positioned on a common vertical surface. The toner replenishment port 8 and the toner passage port 17 of the sealing member 16, which are disposed in alignment, are situated at the center in the inserting and removing directions between the guide wall portions 18 and 20, but they are located at a position close to the guide wall portion 20 on the mounting direction side, rather than at the center, in the mounting and dismounting directions.

Figure 2:
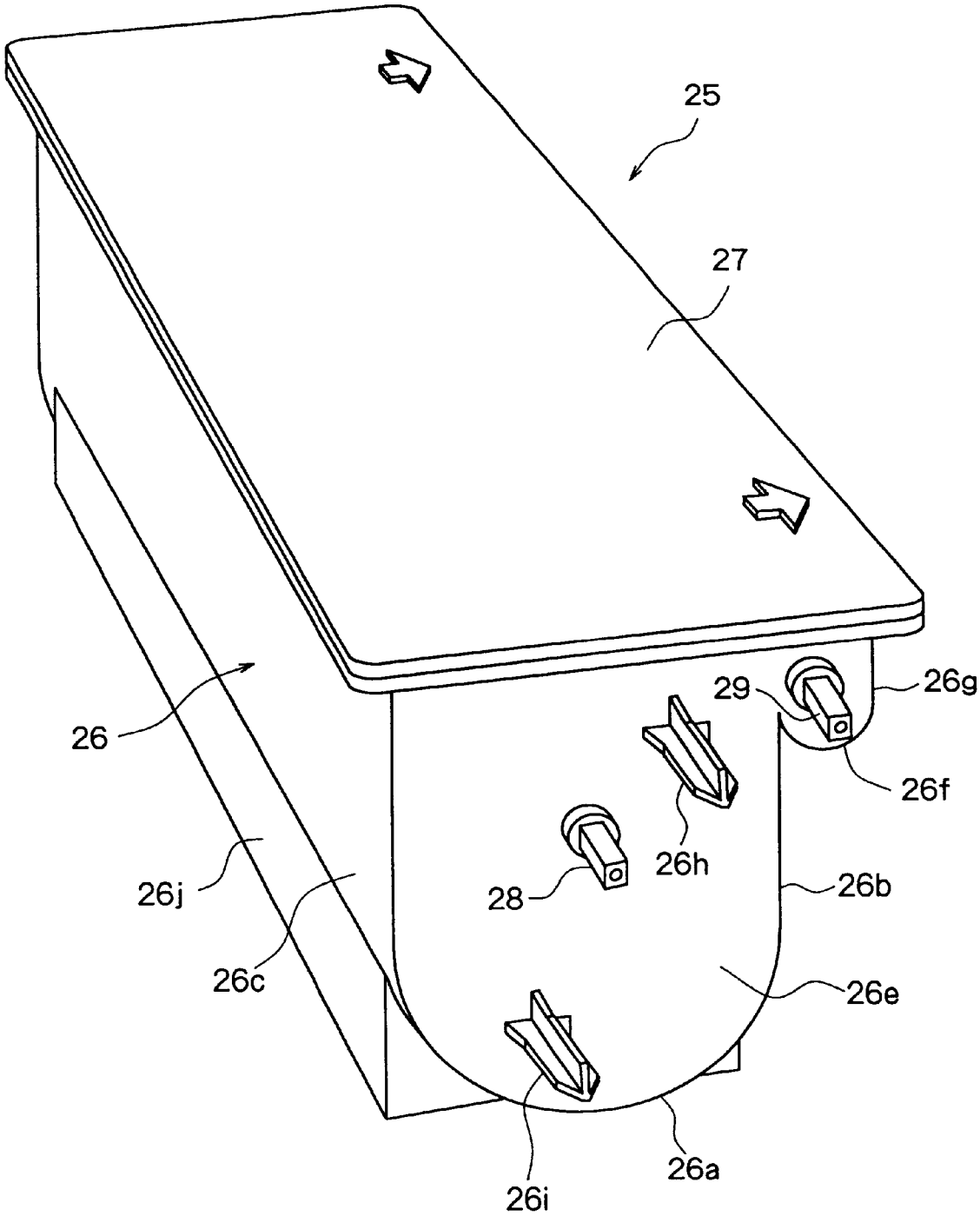
FIG. 2 is a perspective view of a toner cartridge to be mounted on the mounting portion shown in FIG. 1.
Figure 3:
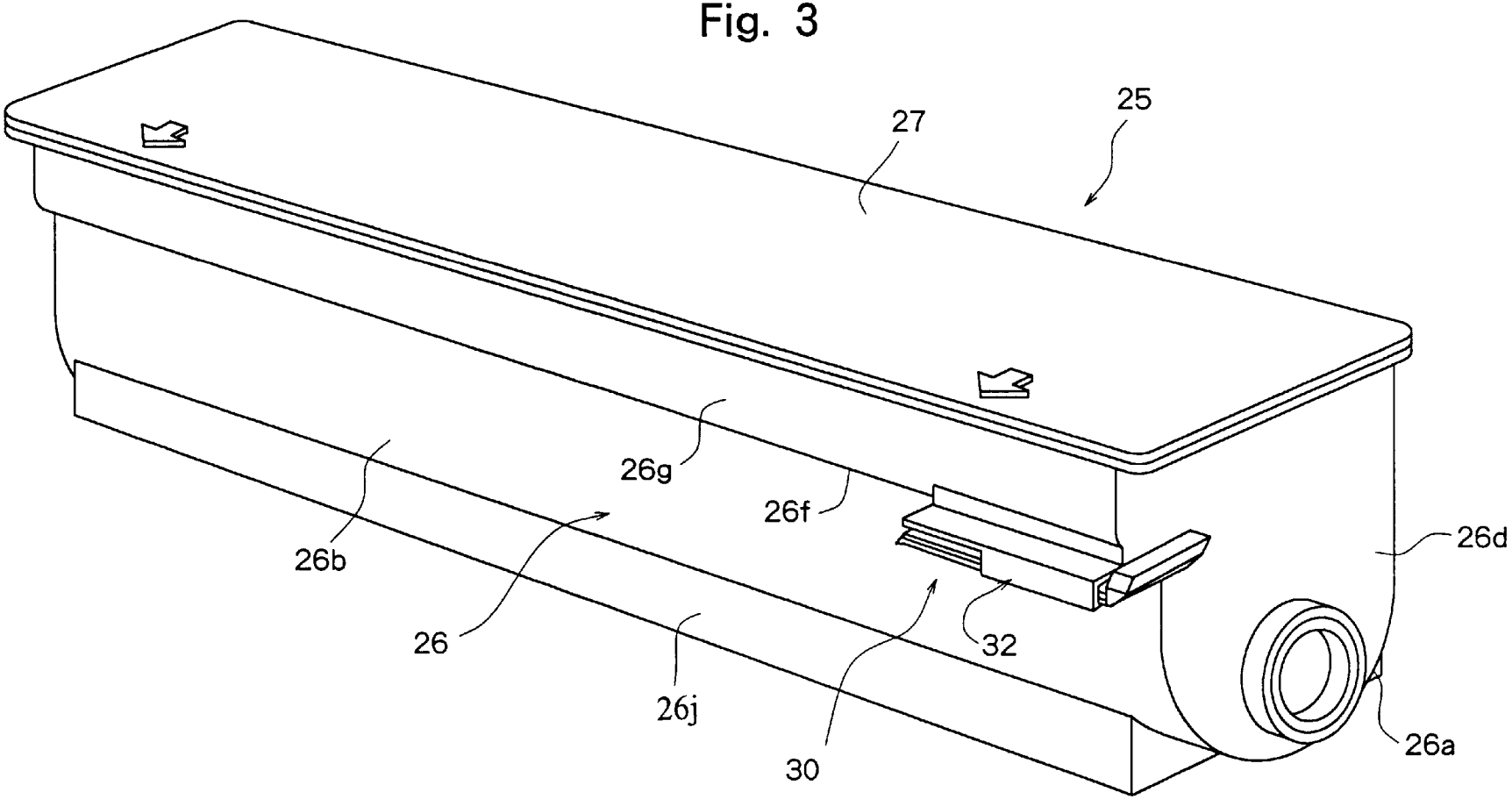
FIG. 3 is a perspective view of the toner cartridge shown in FIG. 2 when viewed from a different direction.

With reference to FIGS. 2 and 3, the toner cartridge 25 has the container body 26. The open upper end of the container body 26 is closed with a lid 27. Arrows showing the direction of insertion of the container body 26 into the mounting portion 2 of the copier body 200 are formed on the upper surface of the lid 27. The container body 26, which can be integrally formed from suitable synthetic resin, includes a nearly semicircular bottom wall 26*a*, a front side wall (the front side wall on the inserting direction side for insertion into the mounting portion 2) 26*b* and a rear side wall 26*c* extending parallel and nearly vertically from both ends of the bottom wall 26*a* toward the open upper end, and one end wall 26*d* and other end wall 26*e* defining one end and the other end in a longitudinal direction. In an upper end portion of the front side wall 26*b*, there are formed a nearly semicircular bottom wall 26*f*, and an upper front side wall 26*g* extending nearly vertically from the front end of the bottom wall 26*f* toward the open upper end. The bottom wall 26*f* has a smaller radius than the radius of the bottom wall 26*a*. A toner transport path (not shown) extending along the upper front side wall 26*g* in the longitudinal direction of the container body 26 is formed in the bottom wall 26*f*. An agitating/scooping mechanism (e.g., a paddle mechanism) for toner is disposed at a position above the bottom wall 26*a* in the container body 26, and a transport mechanism (e.g., a spiral mechanism) for toner is disposed at a position above the bottom wall 26*f* in the container body 26. In FIG. 2, the numeral 28 denotes a driven connecting portion of a rotating shaft of the agitating/scooping mechanism, and the numeral 29 denotes a driven connecting portion of a rotating shaft of the transport mechanism. Each of the driven connecting portions is supported so as to protrude from the other end wall 26*e*. The driven connecting portions 28 and 29 of the rotating shafts are arranged so as to extend parallel in the longitudinal direction of the container body 26 with spacing therebetween. The numerals 26*h* and 26*i* denote positioning pins, and are formed integrally with the other end wall 26*e* so as to protrude from the other end wall 26*e*. A placing flange portion 26*j* is formed at a position below the bottom wall 26*a*. The lower surface of the placing flange portion 26*j* is positioned on the same plane.

Figure 4:
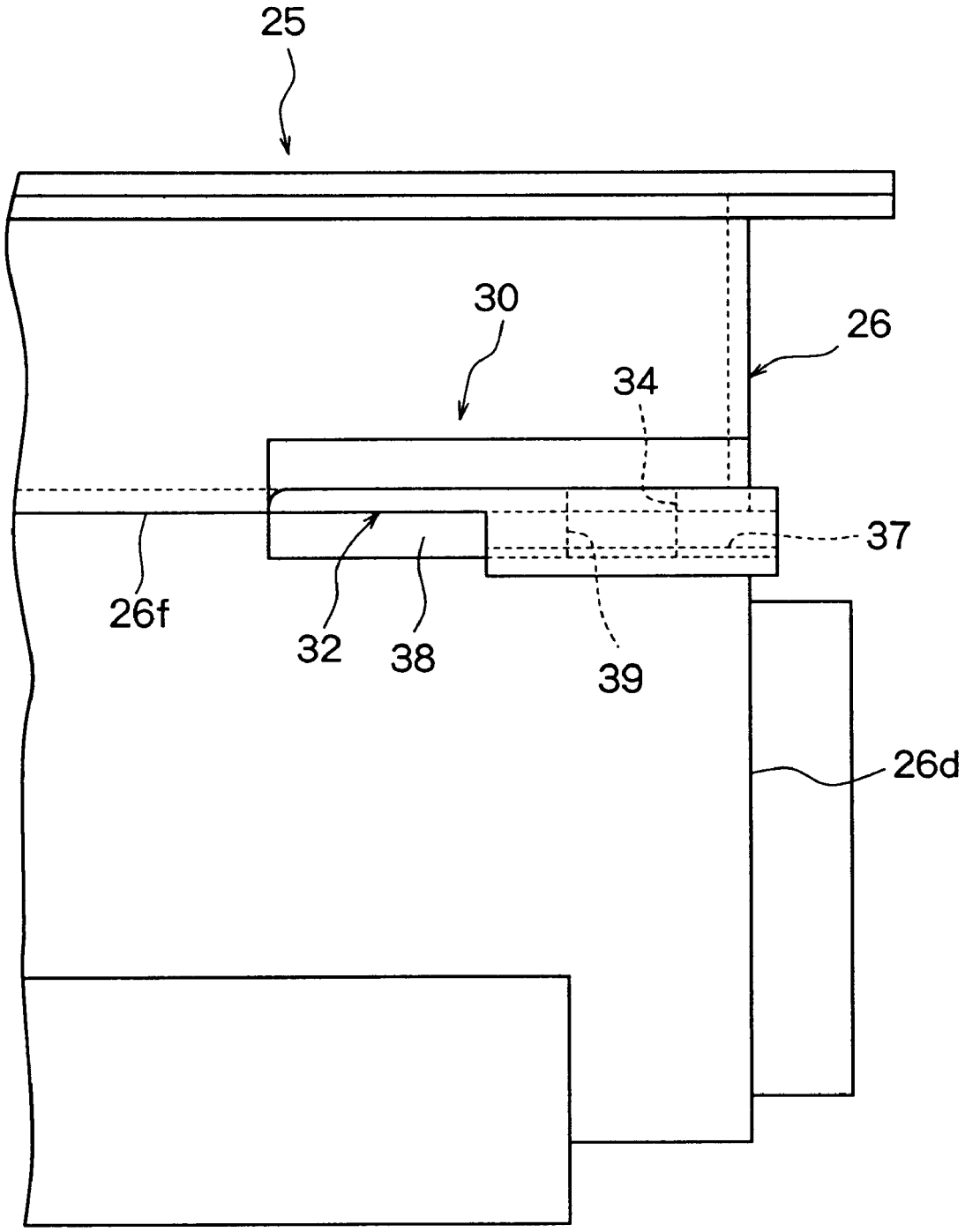
FIG. 4 is a front view of a toner discharge portion of the toner cartridge shown in FIGS. 2 and 3, and is a front view showing a state in which a shutter member is not mounted.
Figure 5:
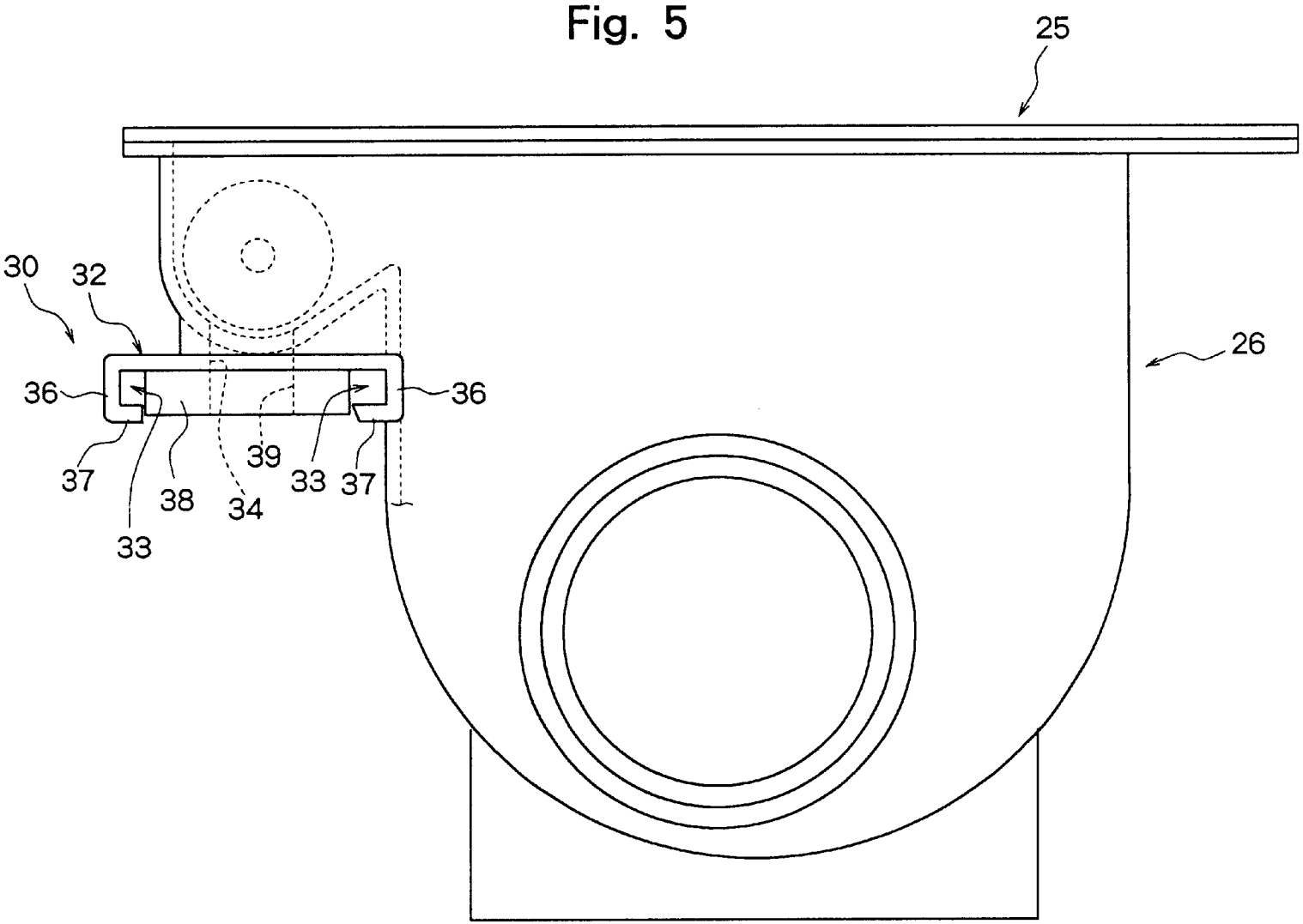
FIG. 5 is a side view of the toner cartridge shown in FIG. 4 as viewed from the right in FIG. 4.
Figure 6:
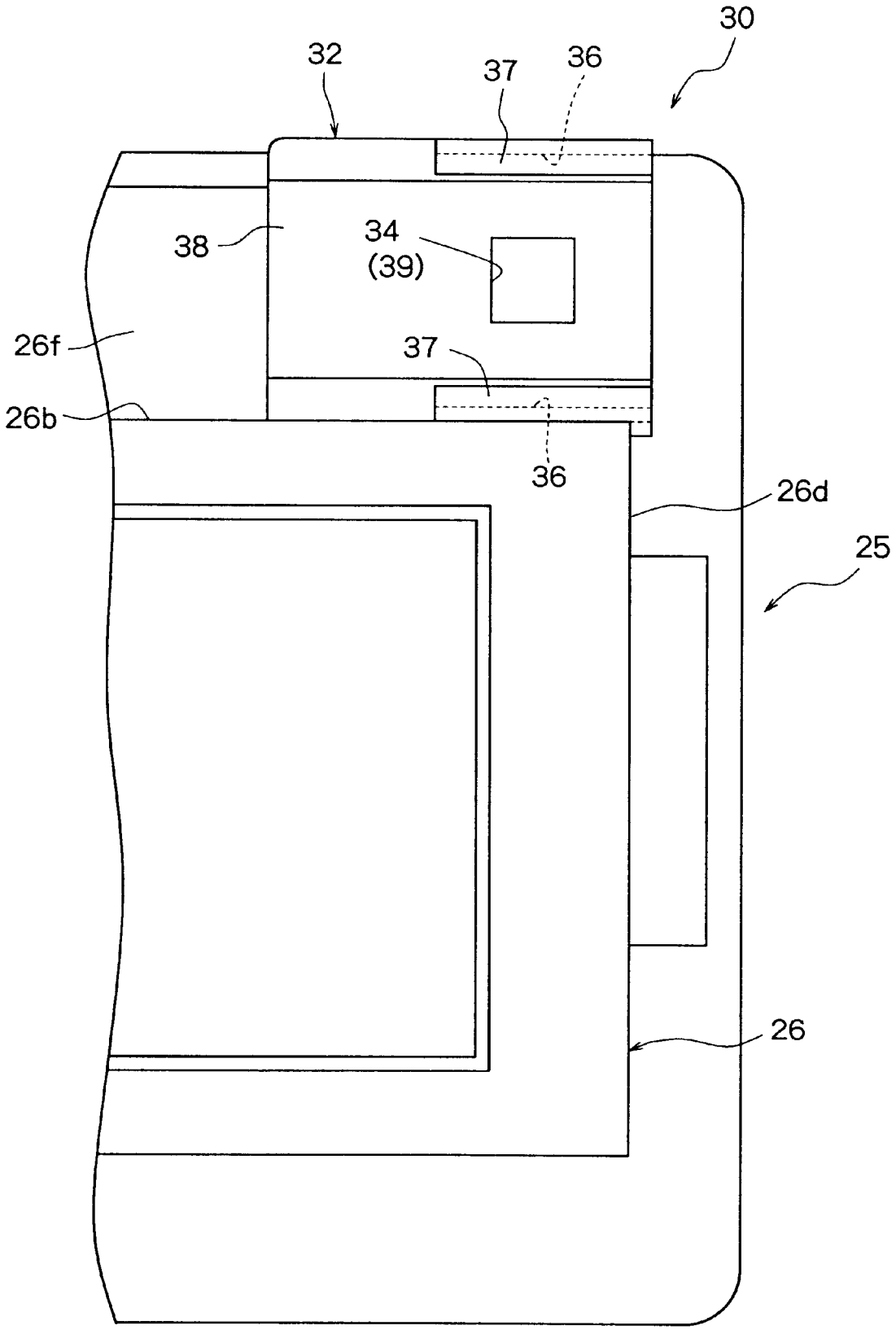
FIG. 6 is a bottom view of the toner cartridge shown in FIG. 4.

With reference to FIGS. 4 to 6, the toner discharge portion 30 is disposed in the container body 26 of the toner cartridge 25. The toner discharge portion 30 has a support wall portion 32 which is formed integrally so as to extend forwardly horizontally from the upper end portion of the front side wall 26*b* and extend along the lower surface of the bottom wall 26*f* in one end portion in the longitudinal direction of the container body 26 and in one end portion of the toner transport path, and which can support a shutter member 40 to be described later (see FIGS. 21 to 24). The support wall portion 32, which takes a substantially rectangular shape when viewed from below, has a predetermined width (the width in the fore-and-aft direction of the container body 26 and the width in the inserting and removing directions thereof) and a predetermined longitudinal length (the length in the longitudinal direction of the container body 26 and the length in the mounting and dismounting directions thereof). The lower surface of the support wall portion 32 is a substantially horizontally extending flat surface, and a toner discharge port 34 formed in the bottom wall 26*f* is open at the lower surface. The toner discharge port 34 is nearly square in shape, and is positioned so as to be open at a predetermined position in the center in the width direction of the support wall portion 32 and closer to the other end in the longitudinal direction (the other end on the mounting direction side) than to the center in the longitudinal direction of the support wall portion 32. Support guide means for supporting and guiding the shutter member 40 are formed at both ends in the width direction of the support wall portion 32. The support guide means are formed at both ends in the width direction of the support wall portion 32 so as to extend from one end in the longitudinal direction of the support wall portion 32 (one end on the dismounting direction side) toward the other end thereof (the other end on the mounting direction side) up to a predetermined position, nearly the central position in the embodiment (the position slightly closer to the other end than to the center), over a length shorter than the overall length in the longitudinal direction of the support wall portion 32. The support guide means is composed of guide side walls 36 extending downward perpendicularly to the lower surface of the support wall portion 32 over the same length from both ends in the width direction of the support wall portion 32, and support flanges 37 extending perpendicularly toward each other from the lower ends of the guide side walls 36. Because of this configuration, channel-shaped guide grooves 33 whose open ends face each other are formed at both ends in the width direction of the support wall portion 32, and it can be said that the support guide means is composed of these guide grooves 33 as a pair. A jutting part of the support wall portion 32 (the part excluding the support guide means), excluding a part integral with the container body 26, is in the shape of a plate extending horizontally with a substantially constant thickness. In the guide side walls 36 and support flanges 37 constituting the support guide means, the jutting part excluding the part integral with the container body 26 is in the shape of a plate. The lower surface of the support wall portion 32, excluding the parts where the guide side walls 36 are formed, is positioned on substantially the same plane, and the lower surfaces of the support flanges 37 are positioned on substantially the same plane.

On the lower surface of the support wall portion 32, a toner discharge port sealing member 38 is disposed so as to surround the peripheral edge of the toner discharge port 34. The sealing member 38, which can be formed from a flexible material such as urethane foam, has a nearly constant thickness and a rectangular planar shape, and is bonded to the lower surface of the support wall portion 32. Both ends in the width direction of the sealing member 38 are positioned between, and slightly inwardly of, the front ends of the support flanges 37, and the lower surface of the sealing member 38 is positioned slightly above the lower surfaces of the support flanges 37. A toner passage port 39 for passage of toner is formed in the sealing member 38. The toner passage port 39 has substantially the same shape and size as those of the toner discharge port 34, and is disposed in alignment with the toner discharge port 34. The longitudinal length of the toner discharge portion 30, i.e., substantially the longitudinal length of the support wall portion 32, is defined to be slightly shorter than the spacing between the front ends of the stop walls 22 and 24 or the upper walls 18*b* and 20*b* in the accepting portion 5.

On the support wall portion 32 thus constituted, the shutter member 40 is supported so as to be movable forward and backward in the longitudinal direction consistent with the aforementioned mounting and dismounting directions. With reference to FIGS. 21 to 24, the shutter member 40, which can be integrally formed from a suitable plastic material, includes a body portion 42 in the shape of a substantially rectangular flat plate and having a toner passage port 41 formed therein, guided means formed at both ends in the width direction of the body portion 42, and a protrusive wall 44 extending upwardly perpendicularly from one end in the longitudinal direction of the body portion 42.

The supported means is composed of supported flanges 45 extending horizontally in a laterally outward direction from the upper surfaces of both ends in the width direction of the body portion 42. The lower surfaces of the supported flanges 45 are positioned on substantially the same plane as the upper surface of the body portion 42. The supported flanges 45 extend linearly, with the same constant width, along both ends of the body portion 42 from one end to a site close to the other end in the longitudinal direction of the body portion 42. The upper surfaces of the supported flanges 45 are positioned on substantially the same plane. The other end part of the body portion 42 protrudes by a predetermined length from the other end of each of the supported flanges 45. One end, in the width direction of the body portion 42, of the other end part forms a claw 43 extending in a downwardly inclined manner in a widthwise outward direction. The front end of the claw 43 slightly protrudes downward from the lower surface of the body portion 42. The protrusive wall 44, when viewed in a plan view, is slender and rectangular, and protrudes by a predetermined length from one end in the longitudinal direction of the body portion 42. The protrusive wall 44 extends, with a substantially constant width and a substantially constant height, along the one end of the body portion 42 from one end in the width direction of the body portion 42 to the front end of the supported flange 45 at the other end in the width direction of the body portion 42. An inclined surface 44*a* inclined downwardly toward one longitudinal end of the protrusive wall 44 is formed on the upper surface at one end in the longitudinal direction of the protrusive wall 44 and on one side in the width direction of the body portion 42. The upper surface of the protrusive wall 44, other than the inclined surface 44*a*, is a flat horizontal surface. The lowermost surface of the protrusive wall 44 is positioned on the same plane as the lower surface of the body portion 42. The toner passage port 41 is in a nearly square shape, and is positioned so as to be open in the center in the width direction of the body portion 42 and at a predetermined position closer to the other end in the longitudinal direction than to the center in the longitudinal direction of the body portion 42. In this embodiment, the toner discharge port 34, toner passage port 39 and toner passage port 41 have substantially the same shape and size, while the toner passage port 17 and toner replenishment port 8 have the same shape as them, but are slightly larger than them. There may, of course, be an embodiment in which all these ports have the same shape and size.

Figure 7:
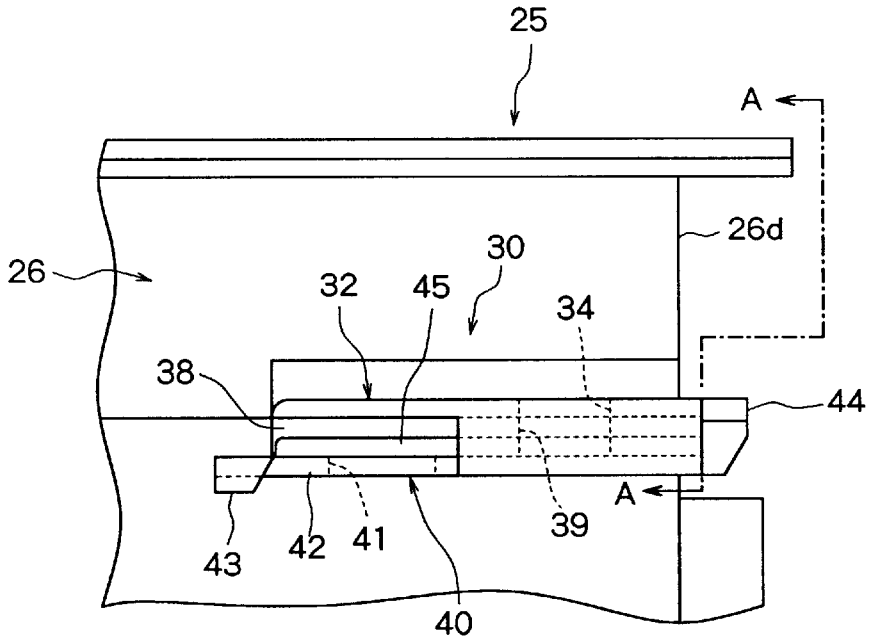
FIG. 7 is a partial front view showing a state in which a shutter member is mounted on the toner discharge portion of the toner cartridge shown in FIG. 4.
Figure 8:
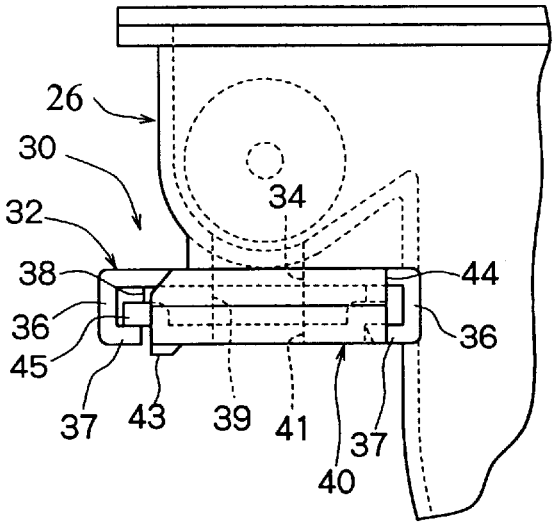
FIG. 8 is a partial side view showing a state in which the shutter member is mounted on the toner discharge portion of the toner cartridge shown in FIG. 5.
Figure 9:
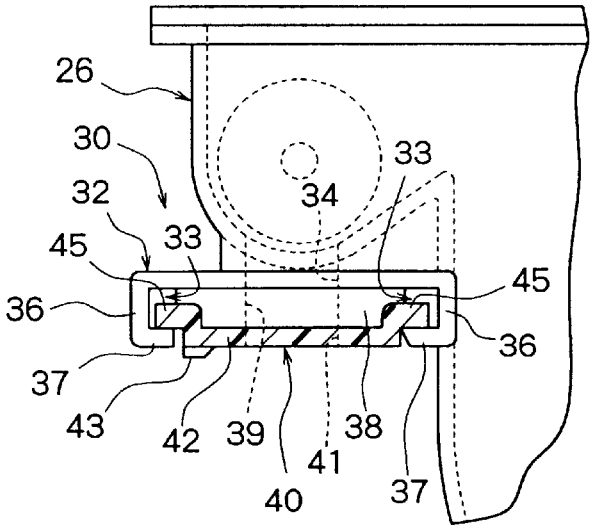
FIG. 9 is a cross sectional view of the shutter member in the toner discharge portion of the toner cartridge shown in FIG. 8.
Figure 10:
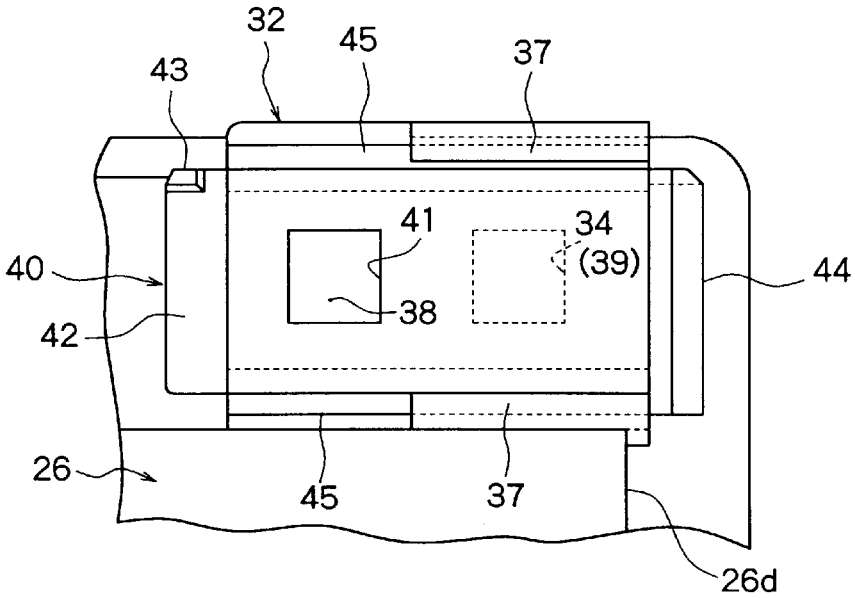
FIG. 10 is a partial bottom view showing a state in which the shutter member is mounted on the toner discharge portion of the toner cartridge shown in FIG. 6.
Figure 11:
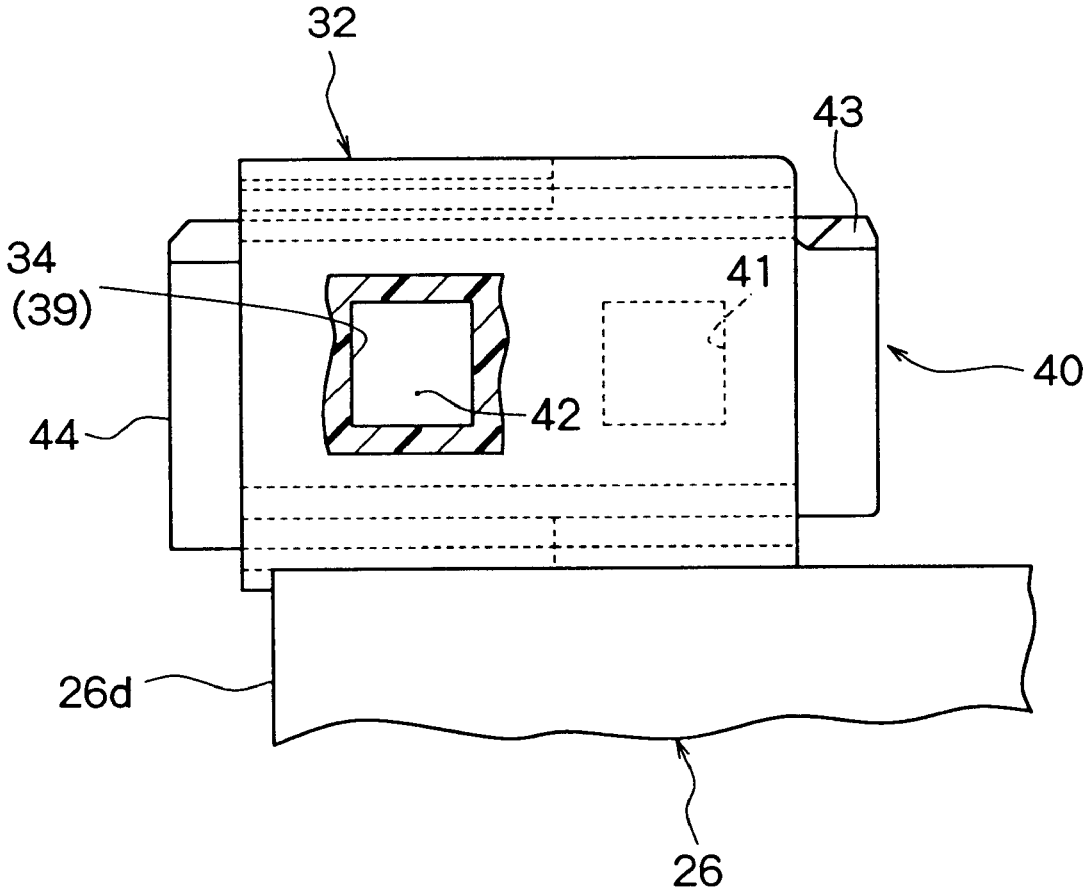
FIG. 11 is a partial plan view showing the toner discharge portion of the toner cartridge in FIG. 8 in a broken away manner.
Figure 12:
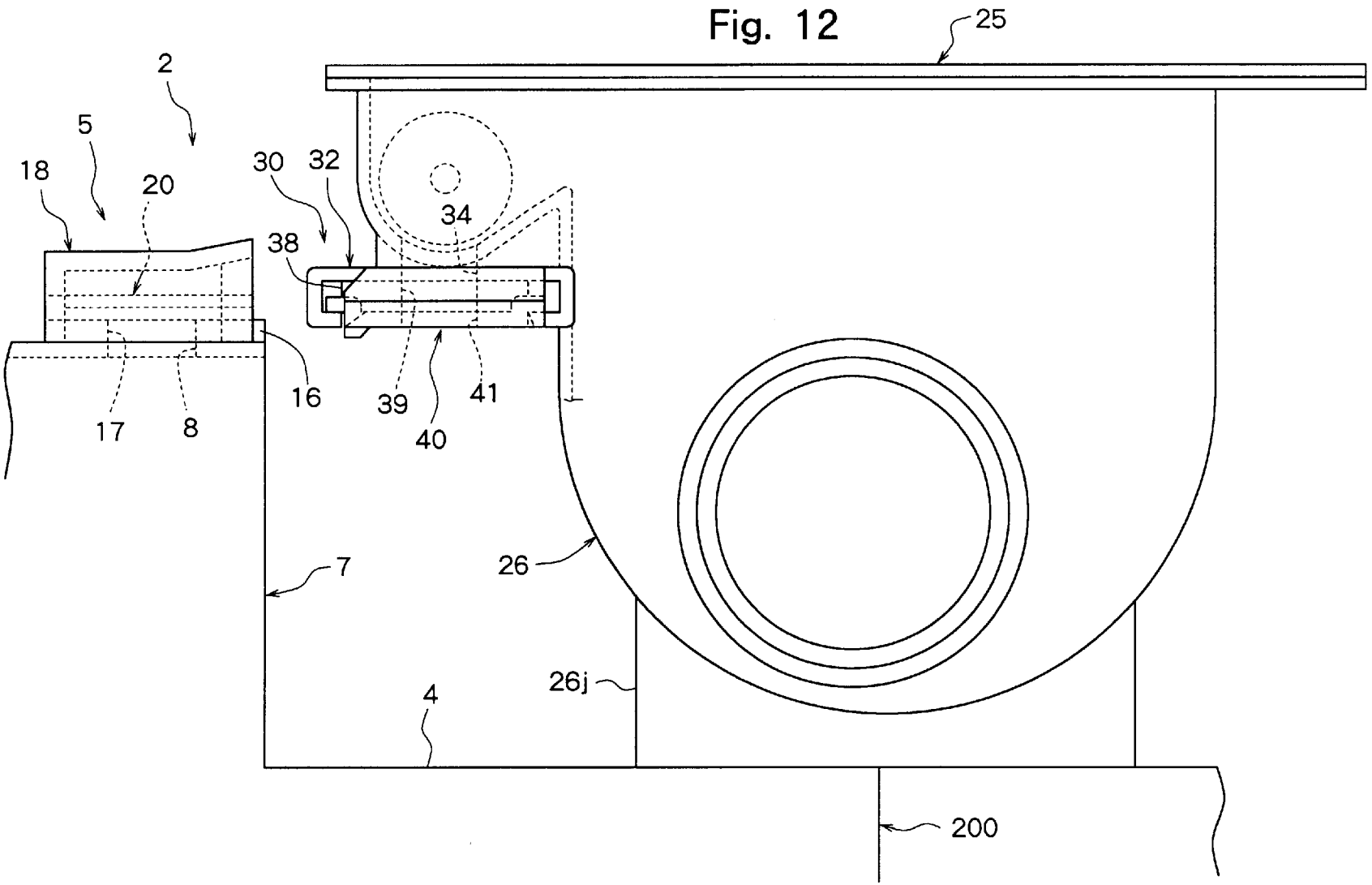
FIG. 12 is a partial side view showing a state in which the toner cartridge is inserted into the mounting portion.

As will be easily understood from FIGS. 7 to 9, the overall width of the shutter member 40 defined between the front ends of the supported flanges 45 is set to be smaller than the width between the opposed inner side surfaces of the guide side walls 36 of the support wall portion 32, and the width of the body portion 42 is set to be slightly smaller than the width between the front ends of the support flanges 37 of the support wall portion 32. The height from the lower surface of the body portion 42 to the upper surface of each of the supported flanges 45 is set to be smaller by a predetermined length than the height dimension from the lower surface of each of the support flanges 37 of the support wall portion 32 to the lower surface of the support wall portion 32. The height from the lower surface of the body portion 42 to the upper surface of the protrusive wall 44 is set to be the same as the height dimension from the lower surface of each of the support flanges 37 of the support wall portion 32 to the upper surface of the support wall portion 32.

With reference to FIGS. 7 to 11, the shutter member 40 constituted as above is mounted removably on the support wall portion 32 by inserting the supported flanges 45 into the corresponding guide grooves 33 of the support wall portion 32 of the container body 26 from one end of the support wall portion 32, and moving them toward the other end of the support wall portion 32. The upper surface of the shutter member 40, concretely, the upper surface of the body portion 42 and the upper surface of the widthwise inside portion of each of the supported flanges 45, are supported by the guide grooves 33 so as to be relatively movable in the longitudinal direction, while elastically deforming the lower surface of the toner discharge port sealing member 38 toward the lower surface of the support wall portion 32. The claw 43 of the body portion 42 of the shutter member 40 is useful for easily and smoothly performing an initial inserting operation for inserting the shutter member 40 into the guide grooves 33 while elastically deforming the sealing member 38. The shutter member 40 is mounted on and supported by the support wall portion 32, with the upper surface of the shutter member 40 being pressed against the lower surface of the sealing member 38, because the protrusive wall 44 is brought into contact with one end of the support wall portion 32 to inhibit the movement of the shutter member 40. The supported flanges 45 of the shutter member 40 are pressed against the upper surfaces of the support flanges 37 of the corresponding guide grooves 33 by the sealing member 38. Thus, the shutter member 40 is firmly supported by the support wall portion 32.

The toner passage port 41 formed in the body portion 42 of the shutter member 40 passes the toner passage port 39 of the sealing member 38, and is positioned closer to the other end of the support wall portion 32 than to the toner passage port 39. The toner passage port 41 in the upper surface of the body portion 42 has its peripheral edge pressed against the sealing member 38 and closed thereby. As a result, the toner passage port 39 of the sealing member 38 and the toner discharge port 34 are closed with the body portion 42 of the shutter member 40 with sufficiently reliable sealability. The shutter member 40 is located at the closing position at which it covers the toner discharge port 34. When the shutter member 40 is moved with a predetermined stroke from the closing position in the opposite direction relative to the support wall portion 32, the shutter member 40 is located at an opening position (not shown) at which the toner passage port 41 of the body portion 42 aligns with the toner passage port 39 of the sealing member 38 and the toner discharge port 34. Thus, the shutter member 40 is mounted on the support wall portion 32 of the container body 26 so as to be movable forward and backward between the closing position for covering the toner discharge port 34 and the opening position for opening the toner discharge port 34. With the shutter member 40 being mounted on the support wall portion 32, the protrusive wall 44, one end portion of the shutter member 40, protrudes longitudinally outwardly (in the dismounting direction) from one end of the support wall portion 32, while the other end of the body portion 42, the other end of the shutter member 40, protrudes longitudinally outwardly (in the mounting direction) from the other end of the support wall portion 32.

With reference to FIGS. 12 to 14 and FIG. 16, in mounting the toner cartridge 25 on the mounting portion 2 of the copier body 200, the container body 26 is placed on the placing surface 4 of the mounting portion 2, the toner discharge portion 30 of the container body 26 is aligned with the accepting portion 5 of the mounting portion 2, and then the container body 26 is moved in the inserting direction. The protrusive wall 44 of the shutter member 40 protruding from one end of the support wall portion 32 is inserted into the guide groove 19 constituted by the guide wall portion 18, while the other end of the shutter member 40 (the other end of the body portion 42) protruding from the other end of the support wall portion 32 is inserted into the guide groove 23 constituted by the guide wall portion 20. Under guidance by these guide grooves, the shutter member 40 is moved. The support flanges 37 of the support wall portion 32 and the lower surface of the shutter member 40 are moved while compressing and elastically deforming the sealing member 16. The protrusive wall 44 and the other end of the shutter member 40 are brought into contact with the corresponding stop walls 22 and 24 to restrain (inhibit) this movement. The support wall portion 32 is positioned between the guide wall portions 18 and 20. The lower surface of the shutter member 40 including the peripheral edge of the toner passage port 41 is pressed against the upper surface of the sealing member 16 and sealed thereby, while the upper surface of the shutter member 40 including the peripheral edge of the toner passage port 41 is pressed against the lower surface of the sealing member 38 and sealed thereby (see FIG. 16). The toner discharge port 34 of the support wall portion 32 and the toner passage port 39 of the sealing member 38 are positioned with a predetermined spacing (spacing between axes) from the toner replenishment port 8 and the toner passage port 17 of the sealing member 16 in the dismounting direction, the direction opposite to the mounting direction. The toner passage port 41 of the shutter member 40 is positioned in alignment with the toner passage port 17 of the sealing member 16 and the toner replenishment port 8. The end surface on the mounting direction side of the support flange 37 on the downstream side in the inserting direction (left side in FIG. 13, upper side in FIG. 14) in the guide groove 33 of the support wall portion 32 is positioned at a predetermined distance from the front end of the stop wall 24 of the guide wall portion 20. The predetermined distance is set to be substantially the same as the aforementioned spacing between the axes. When the container body 26 is positioned at the predetermined inserting position, the lower surface of the support wall portion 32 is located at a position higher by a predetermined distance than the upper surface of the upper wall 20*b* of the guide wall portion 20.

Figure 13:
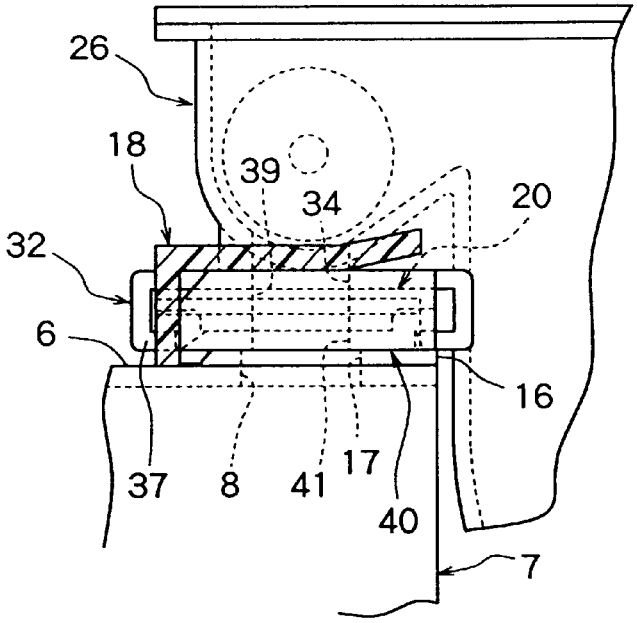
FIG. 13 is a partial side view showing a state in which the toner cartridge has been inserted to an inserting position of the mounting portion, and is a partially broken away view.
Figure 14:
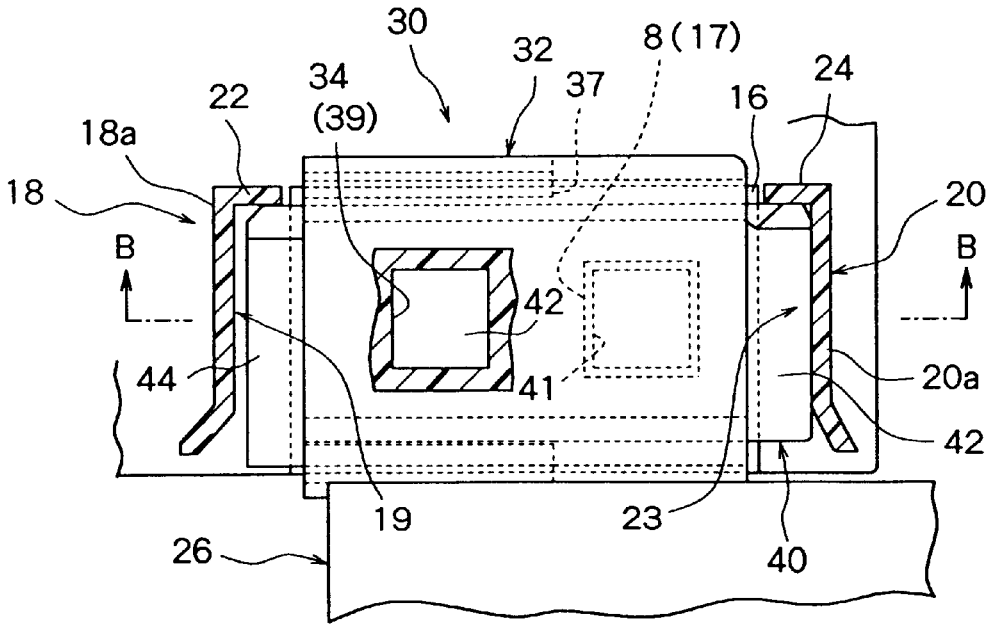
FIG. 14 is a plan view showing part of FIG. 13 broken away.
Figure 16:
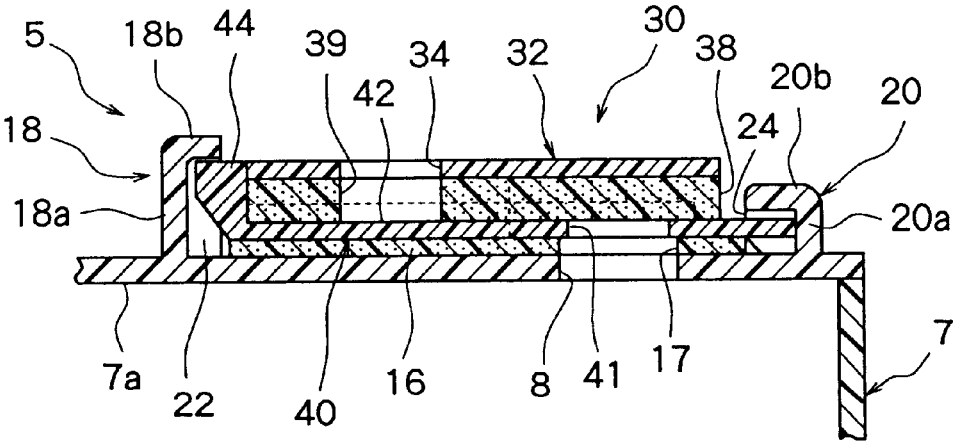
FIG. 16 is a sectional view taken on line B—B of FIG. 14.

In the above-described manner, the container body 26 is inserted and positioned at the predetermined inserting position (see FIGS. 13, 14 and 16). As clear from the above descriptions, the toner discharge portion 30 of the container body 26 is easily, smoothly and fully accurately positioned at the predetermined inserting position in cooperation with the accepting portion 5, simply by moving the container body 26 in the inserting direction. This positioning is performed through cooperation between the toner discharge portion 30 and the accepting portion 5. Thus, there is no need to install a guide mechanism or a positioning mechanism between the other side in the mounting portion 2, which is spaced from the toner discharge portion 30 and the accepting portion 5, and the lower end of the container body 26 as done in the conventional device. Consequently, positioning at a low cost and with high accuracy can be carried out by a simple configuration.

Figure 15:
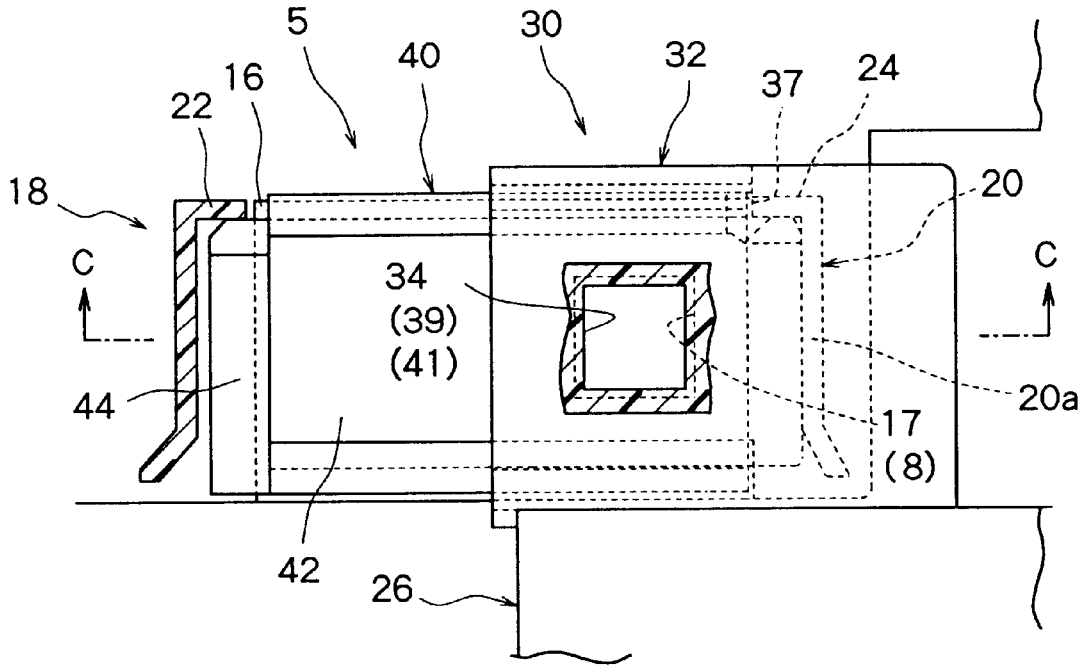
FIG. 15 is a partial plan view showing a state in which the toner cartridge has been located at a mounting position of the mounting portion.
Figure 17:
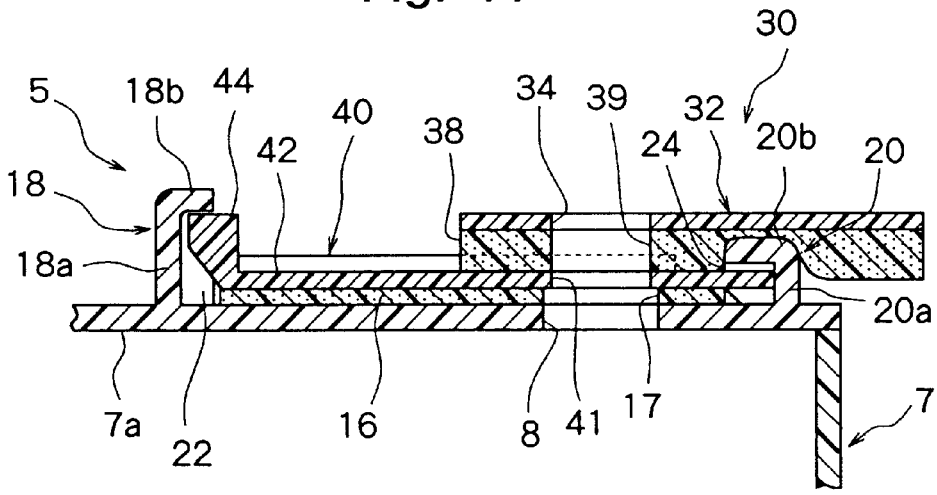
FIG. 17 is a sectional view taken on line C—C of FIG. 15.

When the container body 26 is moved in the mounting portion 2 from the inserting position in the mounting direction, the shutter member 40 is brought into contact with the guide side wall 20*a* of the guide wall portion 20 on the mounting direction side, whereby its movement is inhibited. Thus, the support wall portion 32 is moved in the mounting direction relative to the shutter member 40, with the shutter member 40 being left at the inserting position. When the support wall portion 32 is moved in the mounting direction by a predetermined stroke, the end surface on the mounting direction side of the support flange 37 on the inserting direction side of the support wall portion 32 contacts the front end of the stop wall 24 of the guide wall portion 20 on the mounting direction side to inhibit this movement. The movement of the container body 26 in the mounting direction is stopped, so that the container body 26 is brought to a predetermined mounting position (FIGS. 15 and 17). The positioning pins 26*h* and 26*i* (see FIG. 2) formed so as to protrude from the other end wall 26*e* of the container body 26 are removably engaged into the positioning guide tubes 13 and 14 (see FIG. 1) formed so as to protrude from the drive device accommodation housing 10 of the mounting portion 2, whereby the container body 26 is firmly set in place at the predetermined mounting position. The driven connecting portions 28 and 29 formed so as to protrude from the other end wall 26*e* of the container body 26 are removably drivingly connected with the driving connecting members 12 and 11 formed so as to protrude from the housing 10, whereby the agitating/scooping mechanism and toner transport mechanism within the container body 26 can be driven.

As shown in FIGS. 15 and 17, when the container body 26 is moved to the mounting position, the shutter member 40 is relatively moved from the closing position and located at the opening position. The toner discharge port 34, the toner passage port 39 of the sealing member 38, the toner passage port 41 of the shutter member 40, the toner passage port 17 of the sealing member 16, and the toner replenishment port 8 are positioned in alignment on substantially the same axis. The lower surface of the shutter member 40, including the peripheral edge of the toner passage port 41, is pressed against the upper surface of the sealing member 16 and sealed thereby, while the upper surface of the shutter member 40, including the peripheral edge of the toner passage port 41, is pressed against the lower surface of the sealing member 38 and sealed thereby. As a result, the peripheral edge on the lower surface side of the toner discharge port 34 of the container body 26, and the peripheral edge on the upper surface side of the toner passage port 41 of the shutter member 40 are sealed with the sealing member 38 without occurrence of a gap. Also, the peripheral edge on the lower surface side of the toner passage port 41 of the shutter member 40, and the peripheral edge on the upper surface side of the toner replenishment port 8 of the development housing 7 are sealed with the sealing member 16 without occurrence of a gap. Thus, leakage of toner during movement of the container body 26 in the mounting direction is completely prevented. Also, leakage of toner during toner replenishment and operation of the copier is completely prevented. Hence, the problem of toner scatter to the outside is completely solved.

As clear from the above descriptions, the toner discharge portion 30 of the container body 26 is easily, smoothly and highly accurately positioned at the predetermined mounting position in cooperation with the accepting portion 5, simply by moving the container body 26 from the inserting position in the mounting direction. Concretely, the toner discharge port 34, the toner passage port 39 of the sealing member 38, and the toner passage port 41 of the shutter member 40, which are situated on the toner discharge portion 30 and on the movable side with respect to the stationary accepting portion 5, can be positioned fully accurately in alignment on the same axis, without causing misalignment with the toner passage port 17 of the sealing member 16 and the toner replenishment port 8. Consequently, toner is prevented from adhering to an unfavorable site, for example, the peripheral edge of the toner passage port 41 on the upper surface side of the shutter member 40, or the peripheral edge of the toner passage port 17 on the upper surface side of the sealing member 16, during replenishment of the toner. This resolves the scatter of toner when the container body 26 is removed from the mounting portion 2. Furthermore, the positioning at the predetermined mounting position is performed through cooperation between the toner discharge portion 30 and the accepting portion 5. Thus, there is no need to install a guide mechanism or a positioning mechanism between the other side in the mounting portion 2, which is spaced from the toner discharge portion 30 and the accepting portion 5, and the lower end of the container body 26 as done in the conventional device. Consequently, low cost, high accuracy positioning can be carried out by a simple configuration.

As stated earlier, when the container body 26 is positioned at the predetermined inserting position, the lower surface of the support wall portion 32 is located at a position higher by a predetermined distance than the upper surface of the upper wall 20*b* of the guide wall portion 20. Because of this configuration, a predetermined gap is formed between the lower surface of the support wall portion 32 and the upper surface of the upper wall 20*b* during movement of the support wall portion 32 from the inserting position shown in FIGS. 14 and 16 to the mounting position shown in FIGS. 15 and 17. The sealing member 38 disposed on the lower surface of he support wall portion 32 is compressed and elastically deformed in this gap, and is thus allowed to pass through the gap, so that the movement of the support wall portion 32 in the mounting direction is permitted. The above predetermined distance is set to be at least to such a degree as to permit these actions. As mentioned earlier, moreover, the corner at which the upper surface and the front end surface of the upper wall 20*b* cross is formed as a curved surface. This curved surface contributes to smooth and easy implementation of the elastic deformation and movement of the sealing member 38 in the gap.

To remove the container body 26 from the mounting portion 2 for replacement after complete consumption of toner in the toner cartridge 25, the container body 26 is moved in the dismounting direction in the mounting portion 2. The shutter member 40 has its protrusive wall 44 coming into contact with the guide side wall 18*a* of the guide wall portion 18 on the dismounting side, and is inhibited from moving. Thus, the support wall portion 32 is moved in the dismounting direction relative to the shutter member 40 present at the inserting position. When the support wall portion 32 is moved in the dismounting direction by a predetermined stroke, one end on the dismounting direction side of the support wall portion 32 contacts the protrusive wall 44 of the shutter member 40, so that the movement of the support wall portion 32 is inhibited. In this manner, the container body 26 and the support wall portion 32 are returned to the inserting position. When the container body 26 and the support wall portion 32 are returned to the inserting position, the shutter member 40 is relatively moved from the opening position and brought to the original closing position (see FIGS. 14 and 16). The curved surface of the corner at which the upper wall 20*b* and the guide side wall 20*a* of the guide wall portion 20 cross contributes to performing, smoothly and easily, the elastic deformation and movement of the sealing member 38. Then, the container body 26 is moved in the removing direction relative to the accepting portion 5, the toner discharge portion 30 is removed from the accepting portion 5, and the container body 26 is removed from the mounting portion 2. Under the same action as described previously, the peripheral edge on the lower surface side of the toner discharge port 34 of the container body 26, and the peripheral edge on the upper surface side of the toner passage port 41 of the shutter member 40 are sealed with the sealing member 38 without occurrence of a gap. Also, the peripheral edge on the lower surface side of the toner passage port 41 of the shutter member 40, and the peripheral edge on the upper surface side of the toner replenishment port 8 of the development housing 7 are sealed with the sealing member 16 without occurrence of a gap. Thus, leakage of toner during movement of the container body 26 in the dismounting direction is completely prevented. Hence, the problem of toner scatter to the outside is completely solved. Furthermore, during movement of the container body 26 from the mounting position to the inserting position, the upper surface of the shutter member 40 is wiped and cleaned with the lower surface of the sealing member 38 of the support wall portion 32 being relatively moved. During removal of the container body 26 from the inserting position, moreover, the lower surface of the shutter member 40 is wiped and cleaned with the upper surface of the sealing member 16 of the accepting upper surface 6 being relatively moved. Thus, adhesion of toner is decreased markedly effectively. As a result, when the container body 26 is removed from the mounting portion 2, scatter of toner is decreased markedly effectively. According to the present invention, occurrence of gaps between the support wall portion 32 of the toner discharge portion 30 of the container body 26, the shutter member 40, and the accepting upper surface 6 can be completely prevented. Also, misalignment between the toner discharge port 34 and the toner replenishment port 8, which occurs when the container body 26 of the toner cartridge 25 is mounted on the mounting portion 2, can be kept to a minimum with high accuracy. Thus, leakage and scatter of toner at the time of toner replenishment during operation of the copier, and when the container body 26 is mounted on the mounting portion 2, can be prevented markedly effectively.

I claim:

1. A toner replenishing device comprising:

a toner cartridge mounting portion having a toner replenishment port; and a toner cartridge mounted on the mounting portion, the toner replenishing device being configured such that the cartridge includes a container body having a toner discharge port, a shutter member is mounted on the container body so as to be movable forward and backward between a closing position at which the shutter member covers the toner discharge port and an opening position at which the shutter member opens the toner discharge port, and the container body is inserted into the mounting portion up to an inserting position in an inserting direction perpendicular to directions of forward and backward movements of the shutter member, and is then moved up to a mounting position in a mounting direction in the directions of forward and backward movements, whereby the cartridge is removably mounted on the mounting portion, and wherein the container body is provided with a support wall portion having a lower surface at which the toner discharge port is open, a flexible toner discharge port sealing member having a toner passage port formed therein is disposed on the lower surface of the support wall portion, with the toner passage port being positioned in alignment with the toner discharge port, and the shutter member has a toner passage port, and is supported by the support wall portion and located at the closing position, with an upper surface of the shutter member being pressed against a lower surface of the toner discharge port sealing member, and is also positioned such that opposite end portions of the shutter member in the directions of forward and backward movements protrude outwardly of opposite ends of the support wall portion, the mounting portion includes an accepting upper surface where the toner replenishment port is open, a flexible toner replenishment port sealing member disposed on the accepting upper surface and having a toner passage port formed therein, a pair of guide wall portions disposed so as to extend in the inserting direction while interposing the toner replenishment port sealing member therebetween, and stop walls extending toward each other at downstream ends in the inserting direction of the guide wall portions, the toner passage port of the toner replenishment port sealing member being positioned in alignment with the toner replenishment port, when the container body is moved in the inserting direction relative to the mounting portion to insert the opposite end portions of the shutter member into the corresponding guide wall portions and move the opposite end portions along them, the opposite end portions contact the corresponding stop walls to have their movement inhibited, whereby the container body is inserted and positioned at the inserting position, a lower surface of the shutter member is pressed against an upper surface of the toner replenishment port sealing member and sealed thereby, and the toner passage port of the shutter member is positioned in alignment with the toner passage port of the toner replenishment port sealing member and the toner replenishment port, then when the container body is moved in the mounting direction relative to the mounting portion, the shutter member contacts the guide wall portion on a mounting direction side to have its movement inhibited, and when the support wall portion is moved, relative to the shutter member, in the mounting direction by a predetermined stroke, the support wall portion partly contacts a front end of the stop wall on the mounting direction side to have its movement inhibited, so that the container body is located at the mounting position, and upon movement of the container body up to the mounting position, the shutter member is relatively moved from the closing position to the opening position, the toner discharge port, the toner passage port of the toner discharge port sealing member, the toner passage port of the shutter member, the toner passage port of the toner replenishment port sealing member, and the toner replenishment port are positioned in alignment, and the upper surface and lower surface of the shutter member are pressed against the toner discharge port sealing member and the toner replenishment port sealing member, respectively, and sealed thereby.

2. A toner replenishing device as claimed in claim 1, wherein the pair of guide wall portions include guide side walls erected from the accepting upper surface so as to extend parallel in the inserting direction with spacing therebetween, and upper walls extending toward each other perpendicularly from upper ends of the guide side walls, the stop walls are formed so as to extend toward each other perpendicularly from downstream ends in the inserting direction of the guide side walls, an overall height of the guide wall portion disposed on the mounting direction side is lower than an overall height of the other guide wall portion, and channel-shaped guide grooves having open ends facing each other are formed by the guide wall portions on the accepting upper surface.

3. A toner replenishing device as claimed in claim 2, wherein in the guide wall portion disposed on the mounting direction side, a corner at which an upper surface and an front end surface of the upper wall cross is formed in a curved surface and a corner at which the upper wall and the guide side wall cross is formed in a curved surface.

4. A toner replenishing device as claimed in claim 2, wherein the container body of the toner cartridge includes a front side wall, and a bottom wall formed in an upper end portion of the front side wall and having a toner transport path formed inside and having the toner discharge port formed in one end portion thereof in a longitudinal direction, a toner discharge portion having a support wall portion integrally formed so as to extend forwardly horizontally from the upper end portion of the front side wall and extend along a lower surface of the bottom wall is disposed in one end portion in the longitudinal direction of the container body and in one end portion of the toner transport path, the toner discharge port is disposed so as to be open at the lower surface of the support wall portion, channel-shaped guide grooves having open ends facing each other are formed by guide side walls and support flanges at opposite ends in a width direction of the support wall portion, the guide side walls being formed so as to extend from one end toward the other end in a longitudinal direction of the support wall portion over a length at a predetermined position shorter than an overall length in the longitudinal direction of the support wall portion and extending perpendicularly downwardly from the opposite ends in the width direction of the support wall portion, the support flanges extending perpendicularly toward each other from lower ends of the guide side walls, the toner discharge port sealing member is disposed on the lower surface of the support wall portion so as to surround a peripheral edge of the toner discharge port, a longitudinal length of the support wall portion is set to be shorter than distances between front ends of the stop walls and the upper walls in an accepting portion, and the shutter member is supported in the support wall portion so as to be movable forward and backward in a longitudinal direction consistent with the mounting direction and a dismounting direction.

5. A toner replenishing device as claimed in claim 4, wherein the shutter member includes a body portion of a substantially rectangular flat plate shape and having a toner passage port formed therein, supported flanges extending horizontally in a laterally outward manner from an upper surface at opposite ends in a width direction of the body portion, and a protrusive wall extending upwardly perpendicularly from one end in a longitudinal direction of the body portion, a lower surface of each of the supported flanges is positioned substantially on the same plane as the upper surface of the body portion, the supported flanges are formed so as to extend linearly from one end toward the other end in the longitudinal direction of the body portion along the opposite ends of the body portion with the same constant width, the other end portion of the body portion protrudes by a predetermined length from the other end of each of the supported flanges, when the supported flanges are inserted into the corresponding guide grooves of the support wall portion of the container body from one end of the support wall portion and moved toward the other end of the support wall portion, and the protrusive wall contacts one end of the support wall portion to have its movement inhibited, the shutter member is supported by the guide grooves so as to be relatively movable in the longitudinal direction, with the upper surface of the shutter member elastically deforming the lower surface of the toner discharge port sealing member toward the lower surface of the support wall portion, the toner passage port in the upper surface of the body portion of the shutter member has a peripheral edge pressed against the toner discharge port sealing member and closed thereby, the toner passage port of the toner discharge port sealing member, and the toner discharge port are closed with the body portion of the shutter member, and the shutter member is located at the closing portion at which the shutter member covers the toner discharge port.

6. A toner replenishing device as claimed in claim 5, wherein when the shutter member is mounted on the support wall portion and located at the closing position, the protrusive wall being one end portion of the shutter member is positioned so as to protrude longitudinally outwardly from one end of the support wall portion, and the other end portion of the body portion being the other end portion of the shutter member is positioned so as to protrude longitudinally outwardly from the other end of the support wall portion.

7. A toner replenishing device as claimed in claim 6, wherein when the container body of the toner cartridge is placed on the accepting upper surface of the mounting portion, the toner discharge port of the container body is aligned with the accepting portion of the mounting portion, and then the container body is moved in the inserting direction, the protrusive wall of the shutter member protruding from one end portion of the support wall portion is inserted into the guide groove of the guide wall portion on the dismounting direction side, the other end portion of the shutter member protruding from the other end portion of the support wall portion is inserted into the guide groove of the guide wall portion on the mounting direction side, and the protrusive wall and the other end portion are moved under guidance thereby, the support flanges of the support wall portion and the lower surface of the shutter member are moved while compressing and elastically deforming the toner replenishment port sealing member, when the protrusive wall and the other end portion of the shutter member are contacted with the corresponding stop walls to have their movements restrained, the support wall portion is positioned between the guide wall portions to locate the container body at the inserting position, the lower surface of the shutter member including the peripheral edge of the toner passage port is pressed against the upper surface of the toner replenishment port sealing member and sealed thereby, the upper surface of the shutter member including the peripheral edge of the toner passage port is pressed against the lower surface of the toner discharge port sealing member and sealed thereby, the toner discharge port of the support wall portion and the toner passage port of the toner discharge port sealing member are positioned with predetermined spacing from the toner replenishment port and the toner passage port of the toner replenishment port sealing member in the dismounting direction opposite to the mounting direction, and the toner passage port of the shutter member is positioned in alignment with the toner passage port of the toner replenishment port sealing member and the toner replenishment port.

8. A toner replenishing device as claimed in claim 7, wherein an end surface on the mounting direction side of the support flange of the support wall portion downstream in the inserting direction is positioned with predetermined spacing from the front end of the stop wall of the guide wall portion on the mounting direction side, the predetermined spacing is set to be substantially the same as the predetermined spacing between the toner discharge port of the support wall portion/the toner passage port of the toner discharge port sealing member and the toner replenishment port/the toner passage port of the toner replenishment port sealing member, and when the container body is located at the inserting position, the lower surface between the guide side walls of the support wall portion is located at a position higher by a predetermined distance than the upper surface of the upper wall of the guide wall portion on the mounting direction side.

9. A toner replenishing device as claimed in claim 8, wherein when the container body is moved in the mounting direction from the inserting position, the shutter member contacts the guide side wall of the guide wall portion on the mounting direction side to have its movement inhibited, whereby the support wall portion is moved in the mounting direction relative to the shutter member, with the shutter member remaining at the inserting position, and when the support wall portion is moved in the mounting direction by a predetermined stroke, the end surface on the mounting direction side of the support flange on the inserting direction side of the support wall portion contacts the front end of the stop wall of the guide wall portion on the mounting direction side, whereby movement of the support wall portion is inhibited and the container body is located at the mounting position.

10. A toner replenishing device as claimed in claim 9, wherein when the container body is moved in the dismounting direction from the mounting position, the shutter member has the protrusive wall thereof contacting the guide side wall of the guide wall portion on the dismounting direction side to have its movement inhibited, and the support wall portion is moved in the dismounting direction relative to the shutter member present at the inserting position, and when the support wall portion is moved in the dismounting direction by the predetermined stroke, one end on the dismounting direction side of the support wall portion contacts the protrusive wall of the shutter member, whereby movement of the support wall portion is inhibited and the container body and the support wall portion are returned to the inserting position, while the shutter member is moved relatively from the opening direction and located at the closing position.

11. A toner cartridge to be mounted on a toner cartridge mounting portion of a toner replenishing device having a toner replenishment port, the mounting portion including an accepting upper surface where the toner replenishment port is open, a flexible toner replenishment port sealing member disposed on the accepting upper surface and having a toner passage port formed therein, a pair of guide wall portions disposed so as to extend in an inserting direction while interposing the toner replenishment port sealing member therebetween, and stop walls disposed at downstream ends in the inserting direction of the guide wall portions, the toner passage port of the toner replenishment port sealing member being positioned in alignment with the toner replenishment port, the toner cartridge including a container body having a toner discharge port, and configured such that a shutter member is mounted on the container body so as to be movable forward and backward between a closing position at which the shutter member covers the toner discharge port and an opening position at which the shutter member opens the toner discharge port, and the container body is inserted into the mounting portion up to an inserting position in an inserting direction perpendicular to directions of forward and backward movements of the shutter member, and is then moved up to a mounting position in a mounting direction in the directions of forward and backward movements, whereby the toner cartridge is removably mounted on the mounting portion, and wherein the container body is provided with a support wall portion having a lower surface at which the toner discharge port is open, a flexible toner discharge port sealing member having a toner passage port formed therein is disposed on the lower surface of the support wall portion, with the toner passage port being positioned in alignment with the toner discharge port, the shutter member has a toner passage port, and is supported by the support wall portion and located at the closing position, with an upper surface of the shutter member being pressed against a lower surface of the toner discharge port sealing member, and is also positioned such that opposite end portions of the shutter member in the directions of forward and backward movements protrude outwardly of opposite ends of the support wall portion, when the container body is moved in the inserting direction relative to the mounting portion to insert the opposite end portions of the shutter member into the corresponding guide wall portions and move the opposite end portions along them, the opposite end portions contact the corresponding stop walls to have their movement inhibited, whereby the container body is inserted and positioned at the inserting position, a lower surface of the shutter member is pressed against an upper surface of the toner replenishment port sealing member and sealed thereby, and the toner passage port of the shutter member is positioned in alignment with the toner passage port of the toner replenishment port sealing member and the toner replenishment port, then when the container body is moved in the mounting direction relative to the mounting portion, the shutter member contacts the guide wall portion on a mounting direction side to have its movement inhibited, and when the support wall portion is moved, relative to the shutter member, in the mounting direction by a predetermined stroke, the support wall portion partly contacts a front end of the stop wall on the mounting direction side to have its movement inhibited, so that the container body is located at the mounting position, and upon movement of the container body up to the mounting position, the shutter member is relatively moved from the closing position to the opening position, the toner discharge port, the toner passage port of the toner discharge port sealing member, the toner passage port of the shutter member, the toner passage port of the toner replenishment port sealing member, and the toner replenishment port are positioned in alignment, and the upper surface and lower surface of the shutter member are pressed against the toner discharge port sealing member and the toner replenishment port sealing member, respectively, and sealed thereby.

12. A toner cartridge as claimed in claim 11, wherein the container body includes a front side wall, and a bottom wall formed in an upper end portion of the front side wall and having a toner transport path formed inside and having the toner discharge port formed in one end portion thereof in a longitudinal direction, a toner discharge portion having a support wall portion in tegrally formed so as to extend forwardly horizontally from the upper end portion of the front side wall and extend along a lower surface of the bottom wall is disposed in one end portion in the longitudinal direction of the container body and in one end portion of the toner transport path, the toner discharge port is disposed so as to be open at a lower surface of the support wall portion, channel-shaped guide grooves having open ends facing each other are formed by guide side walls and support flanges at opposite ends in a width direction of the support wall portion, the guide side walls being formed so as to extend from one end toward the other end in a longitudinal direction of the support wall portion over a length at a predetermined position shorter than an overall length in the longitudinal direction of the support wall portion and extending perpendicularly downwardly from the opposite ends in the width direction of the support wall portion, the support flanges extending perpendicularly toward each other from lower ends of the guide side walls, the toner discharge port sealing member is disposed on the lower surface of the support wall portion so as to surround a peripheral edge of the toner discharge port, a longitudinal length of the support wall portion is set to be shorter than distances between front ends of the stop walls and the upper walls in the mounting portion, and the shutter member is supported in the support wall portion so as to be movable forward and backward in a longitudinal direction consistent with the mounting direction and a dismounting direction.

13. A toner cartridge as claimed in claim 12, wherein the shutter member includes a body portion of a substantially rectangular flat plate shape and having a toner passage port formed therein, supported flanges extending horizontally in a laterally outward manner from an upper surface at opposite ends in a width direction of the body portion, and a protrusive wall extending upwardly perpendicularly from one end in a longitudinal direction of the body portion, a lower surface of each of the supported flanges is positioned substantially on the same plane as the upper surface of the body portion, the supported flanges are formed so as to extend linearly from one end toward the other end in the longitudinal direction of the body portion along the opposite ends of the body portion with the same constant width, the other end portion of the body portion protrudes by a predetermined length from the other end of each of the supported flanges, when the supported flanges are inserted into the corresponding guide grooves of the support wall portion of the container body from one end of the support wall portion and moved toward the other end of the support wall portion, and the protrusive wall contacts one end of the support wall portion to have its movement inhibited, the shutter member is supported by the guide grooves so as to be relatively movable in the longitudinal direction, with the upper surface of the shutter member elastically deforming the lower surface of the toner discharge port sealing member toward the lower surface of the support wall portion, the toner passage port in the upper surface of the body portion of the shutter member has a peripheral edge pressed against the toner discharge port sealing member and closed thereby, the toner passage port of the toner discharge port sealing member, and the toner discharge port are closed with the body portion of the shutter member, and the shutter member is located at the closing portion at which the shutter member covers the toner discharge port.

14. A toner cartridge as claimed in claim 13, wherein when the shutter member is mounted on the support wall portion and located at the closing position, the protrusive wall being one end portion of the shutter member is positioned so as to protrude longitudinally outwardly from one end of the support wall portion, and the other end portion of the body portion being the other end portion of the shutter member is positioned so as to protrude longitudinally outwardly from the other end of the support wall portion.

15. A toner cartridge as claimed in claim 13, wherein when the shutter member is moved from the closing position in the opposite direction relative to the support wall portion by a predetermined stroke, the shutter member is located at the opening position at which the toner passage port of the body portion aligns with the toner passage port of the toner discharge port sealing member and the toner discharge port.

* * * * *